US009573404B2

(12) United States Patent
Kasuya et al.

(10) Patent No.: US 9,573,404 B2
(45) Date of Patent: Feb. 21, 2017

(54) MANUFACTURING METHOD AND MANUFACTURING APPARATUS OF SUPPORT FOR PLANOGRAPHIC PRINTING PLATE

(71) Applicant: FUJIFILM Corporation, Minato-ku, Tokyo (JP)

(72) Inventors: Yuichi Kasuya, Shizuoka (JP); Hisashi Hotta, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 1106 days.

(21) Appl. No.: 13/661,623

(22) Filed: Oct. 26, 2012

(65) Prior Publication Data

US 2013/0105327 A1 May 2, 2013

(30) Foreign Application Priority Data

Oct. 28, 2011 (JP) ..... 2011-237636
Oct. 28, 2011 (JP) ..... 2011-237637
(Continued)

(51) Int. Cl.
*C25D 21/12* (2006.01)
*C25D 11/16* (2006.01)
(Continued)

(52) U.S. Cl.
CPC ..... *B41N 3/03* (2013.01); *B41N 3/034* (2013.01); *C23G 1/22* (2013.01); *C23G 1/36* (2013.01);
(Continued)

(58) Field of Classification Search
CPC ..... C25F 3/04; C23F 1/46; C25D 11/16; C25D 21/18; B41N 3/03; B41N 3/034
See application file for complete search history.

(56) References Cited

U.S. PATENT DOCUMENTS 4,724,080 A * 2/1988 Dau ..... B01D 61/16 210/181
5,269,904 A * 12/1993 Fong ..... C25D 11/04 205/106
(Continued)

FOREIGN PATENT DOCUMENTS

CN 1343569 A 4/2002
JP 11059009 A 3/1999
(Continued)

OTHER PUBLICATIONS

Machine Translation of JP 2009-011897A.*
(Continued)

*Primary Examiner* — Bryan D. Ripa
(74) *Attorney, Agent, or Firm* — Sughrue Mion, PLLC

(57) ABSTRACT

A manufacturing method of a support for a planographic printing plate including at least an alkaline etching step of dissolving an aluminum surface layer of an aluminum web with an alkaline solution during a surface roughening treatment on a surface of the aluminum web continuously traveling, the manufacturing method comprising:

a circulating step of cyclically using the alkaline solution between a treatment tank for the etching and an alkaline solution reservoir during adjusting composition concentration of the alkaline solution; and a filtering step of filtering the alkaline solution cyclically used so as to remove solid matter in the alkaline solution.

14 Claims, 11 Drawing Sheets

(30) Foreign Application Priority Data

Jan. 30, 2012 (JP) ..... 2012-016925
Feb. 2, 2012 (JP) ..... 2012-020806

(51) Int. Cl.

| | |
|---|---|
| ***B41N 3/03*** | (2006.01) |
| ***C25F 3/04*** | (2006.01) |
| ***C23G 1/22*** | (2006.01) |
| ***C23G 1/36*** | (2006.01) |
| ***C23G 3/02*** | (2006.01) |
| ***C25D 11/08*** | (2006.01) |
| ***C25D 21/06*** | (2006.01) |
| ***C25D 21/18*** | (2006.01) |
| ***C25D 11/00*** | (2006.01) |

(52) U.S. Cl.

CPC ..... *C23G 3/023* (2013.01); *C23G 3/027* (2013.01); *C23G 3/028* (2013.01); *C23G 3/029* (2013.01); *C25D 11/005* (2013.01); *C25D 11/08* (2013.01); *C25D 11/16* (2013.01); *C25D 21/06* (2013.01); *C25D 21/18* (2013.01); *C25F 3/04* (2013.01)

(56) References Cited

U.S. PATENT DOCUMENTS

| | | | | |
|---|---|---|---|---|
| 5,686,231 | A | 11/1997 | Kasakura et al. | |
| 5,985,165 | A * | 11/1999 | Fukuta | B41N 3/03 216/93 |
| 6,764,587 | B2 | 7/2004 | Sawada et al. | |
| 2002/0056648 | A1 * | 5/2002 | Sawada | B41N 3/034 205/219 |
| 2003/0165768 | A1 | 9/2003 | Hotta et al. | |
| 2004/0077140 | A1 * | 4/2004 | Andricacos | C25D 11/02 438/240 |
| 2004/0200806 | A1 * | 10/2004 | Izuta | C23F 1/46 216/99 |
| 2004/0262209 | A1 * | 12/2004 | Umezawa | B01D 29/114 210/220 |
| 2009/0057943 | A1 * | 3/2009 | Nishimura | B29C 41/26 264/169 |
| 2009/0169920 | A1 * | 7/2009 | Oshima | B41C 1/1016 428/688 |

FOREIGN PATENT DOCUMENTS

| | | | | |
|---|---|---|---|---|
| JP | 2003-112484 | A | | 4/2003 |
| JP | 2004-066650 | A | | 3/2004 |
| JP | 2004114324 | A | | 4/2004 |
| JP | 2005060781 | A | * | 3/2005 |
| JP | 2008279552 | A | | 11/2008 |
| JP | 2009011897 | A | * | 1/2009 |
| WO | 2009122882 | A1 | | 10/2009 |

OTHER PUBLICATIONS

"The Evolution of Filtration for Plating" by Berg et al., Plat. Surf. Finish. 65(1) (1978).*

Machine Translation of JP 2005-060781A.*

Communication, dated Jan. 15, 2013, issued in corresponding EP Application No. 12190135.9, 5 pages.

Notification of Reasons for Rejection, dated Nov. 27, 2013, issued in corresponding JP Application No. 2012-020806, 6 pages in English and Japanese.

Notification of Reasons for Rejection, dated Nov. 27, 2013, issued in corresponding JP Application No. 2012-016925, 6 pages in English and Japanese.

The First Office Action, dated Oct. 28, 2015, issued in corresponding CN Application No. 201210418211.8, 16 pages in English and Chinese.

Communication dated May 3, 2016 issued by the State Intellectual Property Office of the People's Republic of China in counterpart application No. 201210418211.8.

* cited by examiner

FIG.7A

| ITEM | ALKALINE SOLUTION CONDITION | | | SOLID MATTER REMOVAL MEANS | | | FILTERED SOLUTION EVALUATION | | | GRAINED SURFACE EVENNESS | WASTE SOLUTION AMOUNT EVALUATION [USUAL CONDITION: 1] | TOTAL EVALUATION | NOTE |
|---|---|---|---|---|---|---|---|---|---|---|---|---|---|
| | BEFORE SOLID MATTER FILTRATION | | NEW SOLUTION SUPPLE-MENTAL AMOUNT | PORE SIZE OF MEMBRANES | | RECYCLE OF SOLU-TION | SOLID MATTER CONTENT AFTER FILTRA-TION [ppm] | CHARAC-TERISTIC VALUE TURBIDITY [NTU] | SOLID MATTER REMOVAL PERFORMANCE | | | | |
| | SOLID MATTER CONTENT | TURBIDITY | | FIRST STAGE | SECOND STAGE | | | | | | | | |
| UNIT | [ppm] | [NTU] | [USUAL CONDITION: 1] | [μm] | [μm] | | | | | | | | |
| EXAMPLE CASE1 | 1500 | 600 | 1 | 10 | 8 | YES | 30 | 50 | S | EVEN | 1 | A | |
| EXAMPLE CASE2 | 1500 | 600 | 1 | 20 | 8 | YES | 50 | 80 | S | EVEN | 1 | A | |
| EXAMPLE CASE3 | 1500 | 600 | 1 | 30 | 8 | YES | 100 | 150 | A | EVEN | 1 | A | |
| EXAMPLE CASE4 | 1500 | 600 | 1 | 10 | 1 | YES | 10 | 10 | S | EVEN | 1 | A | |
| EXAMPLE CASE5 | 1500 | 600 | 1 | 30 | 8 | YES | 100 | 150 | A | EVEN | 1 | A | |
| EXAMPLE CASE6 | 500 | 350 | 1 | 5 | 8 | YES | 50 | 80 | S | EVEN | 1 | B | FIRST STAGE: SHORTER FILTRATION DURABILITY |
| EXAMPLE CASE7 | 500 | 350 | 1 | 10 | 0.5 | YES | 10 | 10 | S | EVEN | 1 | B | SECOND STAGE: SHORTER FILTRATION DURABILITY |

FIG.7B

| ITEM | ALKALINE SOLUTION CONDITION | | | SOLID MATTER REMOVAL MEANS | | | FILTERED SOLUTION EVALUATION | | | GRAINED SURFACE EVENNESS | WASTE SOLUTION AMOUNT EVALUATION [USUAL CONDITION: 1] | TOTAL EVALUATION | NOTE |
|---|---|---|---|---|---|---|---|---|---|---|---|---|---|
| | BEFORE SOLID MATTER FILTRATION | | NEW SOLUTION SUPPLE-MENTAL AMOUNT | PORE SIZE OF MEMBRANES | | RECYCLE OF SOLU-TION | SOLID MATTER CONTENT AFTER FILTRA-TION [ppm] | CHARAC-TERISTIC VALUE TURBIDITY [NTU] | SOLID MATTER REMOVAL PERFORMANCE | | | | |
| | SOLID MATTER CONTENT | TURBIDITY | | FIRST STAGE | SECOND STAGE | | | | | | | | |
| UNIT | [ppm] | [NTU] | [USUAL CONDITION: 1] | [μm] | [μm] | | | | | | | | |
| EXAMPLE CASE8 | 500 | 350 | 3 | 10 | 5 | NO | 50 | 80 | S | EVEN | 3 | B | MORE WASTE SOLUTION, POOR IN ECONOMIC EFFICIENCY |
| EXAMPLE CASE9 | 200 | 250 | 1 | 30 | 8 | YES | 80 | 120 | A | EVEN | 1 | A | |
| EXAMPLE CASE10 | 190 | 250 | 1 | 30 | - | YES | 90 | 140 | A | EVEN | 1 | A | |
| EXAMPLE CASE11 | 190 | 250 | 1 | 20 | - | YES | 50 | 80 | S | EVEN | 1 | A | |
| EXAMPLE CASE12 | 190 | 250 | 1 | 5 | - | YES | 15 | 20 | S | EVEN | 1 | A | |
| EXAMPLE CASE13 | 190 | 250 | 1 | 1 | - | YES | 10 | 10 | S | EVEN | 1 | A | |
| EXAMPLE CASE14 | 190 | 250 | 1 | 0.1 | - | YES | 10 | 10 | S | EVEN | 1 | B | SHORTER FILTRATION DURABILITY |

FIG.7C

| ITEM | ALKALINE SOLUTION CONDITION | | | SOLID MATTER REMOVAL MEANS | | | FILTERED SOLUTION EVALUATION | | | GRAINED SURFACE EVENNESS | WASTE SOLUTION AMOUNT EVALUATION [USUAL CONDITION: 1] | TOTAL EVALUATION | NOTE |
|---|---|---|---|---|---|---|---|---|---|---|---|---|---|
| | BEFORE SOLID MATTER FILTRATION | | NEW SOLUTION SUPPLE-MENTAL AMOUNT | PORE SIZE OF MEMBRANES | | RECYCLE OF SOLU-TION | SOLID MATTER CONTENT AFTER FILTRA-TION [ppm] | CHARAC-TERISTIC VALUE TURBIDITY [NTU] | SOLID MATTER REMOVAL PERFORMANCE | | | | |
| | SOLID MATTER CONTENT | TURBIDITY | | FIRST STAGE | SECOND STAGE | | | | | | | | |
| UNIT | [ppm] | [NTU] | [USUAL CONDITION: 1] | [μm] | [μm] | | | | | | | | |
| COMPAR-ATIVE EXAMPLE1 | 120 | 180 | 1 | - | - | - | 120 | 180 | C | UNEVEN | 1 | C | |
| COMPAR-ATIVE EXAMPLE2 | 1500 | 600 | 1 | - | - | - | 1500 | 600 | C | UNEVEN | 1 | C | |
| COMPAR-ATIVE EXAMPLE3 | 500 | 350 | 5 | - | - | - | 100 | 150 | A | EVEN | 5 | C | MORE WASTE SOLUTION, POOR IN ECONOMIC EFFICIENCY |

FIG.8

| | ABRASIVES ADDITIVE AMOUNT (g/L) | FILTRATION RATE (m/hr) | FILTER MEMBRANE CLEANING FREQUENCY (INDEX) | TOTAL EVALUATION |
|---|---|---|---|---|
| TEST CASE 1 | 0 | 0.1 | 1 | C. FILTER MEMBRANES ARE CLOGGED, AND FILTRATION RATE IS LOW. |
| TEST CASE 2 | 0.03 | 0.5 | 1 | B. EFFECT TO REDUCE FILTRATION-RATE DETERIORATION IS SMALL. |
| TEST CASE 3 | 0.05 | 0.8 | 1 | A. EFFECT TO REDUCE FILTRATION-RATE DETERIORATION IS GREAT. |
| TEST CASE 4 | 0.15 | 1.0 | 1.5 | A. EFFECT TO REDUCE FILTRATION-RATE DETERIORATION IS GREAT. |
| TEST CASE 5 | 0.30 | 0.8 | 2 | A. EFFECT TO REDUCE FILTRATION-RATE DETERIORATION IS GREAT. |
| TEST CASE 6 | 0.80 | 0.7 | 5 | B. EFFECT TO REDUCE FILTRATION-RATE DETERIORATION IS GREAT; CLEANING FREQUENCY IS INCREASED. |
| TEST CASE 7 | 1.00 | 0.6 | 7 | B. EFFECT TO REDUCE FILTRATION-RATE DETERIORATION IS RELATIVELY SMALL; CLEANING FREQUENCY IS FURTHER INCREASED. |
| TEST CASE 8 | 1.20 | 0.3 | 10 | C. EFFECT TO REDUCE FILTRATION-RATE DETERIORATION IS SMALL; CLEANING FREQUENCY IS GREATLY INCREASED. |

FIG.9

| ITEM | SOLUTION CONDITION | | | SOLID MATTER REMOVAL MEANS | | FILTRATION EVALUATION | | | | |
|---|---|---|---|---|---|---|---|---|---|---|
| | BEFORE SOLID MATTER FILTRATION | | LOCATION OF FILTRATION | MEMBRANE PORE SIZE | | AFTER SOLID MATTER FILTRATION | | SOLID MATTER REMOVAL PERFORMANCE | METALLIC COPPER MIXTURE | TOTAL EVALUATION |
| | SOLID MATTER MIXTURE | TURBIDITY | FROM COPPER ION REMOVAL APPARATUS | FIRST STAGE | SECOND STAGE | SOLID MATTER MIXTURE | TURBIDITY | | | |
| UNIT | [ppm] | [NTU] | | [μm] | [μm] | [ppm] | [NTU] | | | |
| EXAMPLE CASE1 | 200 | 250 | DOWNSTREAM | 10 | - | 20 | 50 | A | A | A |
| EXAMPLE CASE2 | 200 | 250 | DOWNSTREAM | 10 | 4 | 10 | 20 | S | A | S |
| EXAMPLE CASE3 | 200 | 250 | DOWNSTREAM | 10 | 6 | 15 | 40 | A | A | A |
| EXAMPLE CASE4 | 200 | 250 | UPSTREAM | 10 | - | 20 | 50 | A | B | B |
| EXAMPLE CASE5 | 500 | 350 | DOWNSTREAM | 10 | - | 30 | 70 | B | A | B |
| EXAMPLE CASE6 | 200 | 250 | DOWNSTREAM | 4 | - | 10 | 20 | S | A | B |
| COMPARATIVE EXAMPLE1 | 200 | 250 | DOWNSTREAM | - | - | 250 | 250 | C | B | C |

MANUFACTURING METHOD AND MANUFACTURING APPARATUS OF SUPPORT FOR PLANOGRAPHIC PRINTING PLATE

BACKGROUND OF THE INVENTION

Field of the Invention

The present invention relates to a manufacturing method and a manufacturing apparatus of a support for a planographic printing plate, particularly relates to an alkaline etching treatment using an alkaline solution applied to a low purity aluminum web, and relates to an acid etching treatment using an acid electrolytic solution applied to an aluminum web.

Description of the Related Art

In general, an aluminum support for a planographic printing plate (referred to as a "support for a planographic printing plate", hereinafter) is manufactured by graining (surface roughening treatment) at least one surface of an aluminum web that is a thin web plate, and forming an anodic oxidation film on this roughened surface formed through the surface roughening treatment. A thin plate of pure aluminium or an aluminum alloy with purity of 99.5 wt % or more is commonly used as a material of an aluminum web to be manufactured into support for a planographic printing plate.

For the purpose of applying a function of a planographic printing plate for an application to the spread of the CTP (computer to plate) technology, impurities (dissimilar metal) may be added in aluminum. In the viewpoint of energy saving, it has been studied on that a support for a planographic printing plate is manufactured by utilizing recycled aluminum ground metal made from scrap materials or recycled materials of planographic printing plates.

The roughened surface of the support of a planographic printing plate produced as described above is coated with a plate-making layer forming solution such as a photosensitive layer forming solution and a heat-sensitive layer forming solution, and is dried so as to produce a photosensitive or heat-sensitive printing surface. In this manner, a web for a planographic printing plate is manufactured.

In the above mentioned roughened surface, a surface of an aluminum web is normally provided with a brush graining treatment for roughening the surface; an alkaline etching treatment for processing the aluminum web with an alkaline solution so as to dissolve a surface layer thereof; and an electrolytic surface roughening treatment for applying AC electrolysis to an aluminum web in an acid electrolytic solution.

In the an anode oxidation film treatment, DC electrolysis is applied to an aluminum web in anode oxidation treatment solution containing a strong acid such as a sulphuric acid solution, a phosphoric acid solution, and a sulfonic acid solution as an acid component.

Japanese Patent Application Laid-Open No. 2004-066650 discloses an alkaline etching technique. In a manufacturing method of a support for a planographic printing plate, Japanese Patent Application Laid-Open No. 2003-112484 discloses a brush graining treatment for roughening a surface of an aluminum web, an electrolytic surface roughening treatment for carrying out AC electrolysis on an aluminum web in an acid electrolytic solution, an anode oxidation treatment for forming an anode oxidation film on an aluminum web in an acid solution.

Unfortunately, in an alkaline etching treatment, although composition concentration of an alkaline solution cyclically used is adjusted at a constant level, the etching performance gradually becomes deteriorated while the alkaline solution is being cyclically used.

Deterioration of the etching performance varies hole diameter distributions of pits formed on a roughened surface of an aluminum web, which hinders a constant quality level of a support for a planographic printing plate. Consequently, this deteriorates the printing resistance and the fouling resistance of a planographic printing plate manufactured as a finished product.

In acid etching, since an aluminum material constituting an aluminum web contains not a few impurities, various kinds of solid matters resulted from such impurities (intermetallic compounds or deposits) may be generated in an acid electrolytic solution used in an electrolytic surface roughening treatment, or an acid solution used in an anode oxidation treatment. Such generated solid matters are precipitated onto rollers, and may be transferred or cause flaws on the aluminum web, or generate an uneven roughened surface of the aluminum web, which may result in defects on an anode oxidation film thereof.

These disadvantages in the alkaline etching and the acid etching become notable particularly in use of a low purity aluminum web such as an aluminum web having low purity of 99.4 wt % or less, particularly 99.0 wt % or less (98.5 wt %, for example).

In some cases, impurities (dissimilar metal) are added in aluminum for the purpose of applying a function of a planographic printing plate for an application to the CTP (computer to plate). In the viewpoint of energy saving, it has been studied on that a support for a planographic printing plate is manufactured by utilizing recycled aluminum ground metal made of scrap materials or recycled materials of planographic printing plates.

SUMMARY OF THE INVENTION

An object of the present invention, which has been made in order to solve the disadvantages according to the conventional art, is to provide a manufacturing method and a manufacturing apparatus of a support for a planographic printing plate, capable of effectively reducing deterioration of the etching performance even if an alkaline solution is cyclically used in alkaline etching, thereby avoiding deterioration of printing resistance and fouling resistance of a planographic printing plate manufactured as a finished product; and in particular, capable of effectively reducing deterioration of the etching performance even in the case of using a low purity aluminum web.

The object of the present invention is also to provide a manufacturing method and a manufacturing apparatus of a support for a planographic printing plate capable of effectively reducing unevenness of a roughened surface or defects on an anode oxidation film in an electrolytic surface roughening treatment and in an anode oxidation treatment in acid etching.

In order to attain the object of the present invention, the manufacturing method of a support for a planographic printing plate according to the present invention includes at least an alkaline etching step of dissolving an aluminum surface layer of an aluminum web with an alkaline solution during a surface roughening treatment on a surface of the aluminum web continuously traveling. The manufacturing method further includes: a circulating step of cyclically using the alkaline solution between a treatment tank for the etching and an alkaline solution reservoir during adjusting composition concentration of the alkaline solution; and a filtering step of filtering the alkaline solution cyclically used so as to remove solid matter in the alkaline solution.

The present inventors conducted enthusiastic studies on causes of gradual deterioration of etching performance during cyclical use of the alkaline solution in the alkaline etching treatment in spite of adjusting the composition concentration of the alkaline solution cyclically used. As a result, the following findings were obtained: (1) among composition components dissolved in the alkaline solution from the aluminum web, precipitated solid matter of ppm order (such as hydroxides) strongly affects deterioration of the etching performance; and (2) solid matter concentration of the alkaline solution exceeding 100 ppm affects the etching performance.

The present invention has been made based on these findings; and the present invention employs composition concentration adjustment of the alkaline solution cyclically used as well as filtering of solid matter precipitated in the alkaline solution. Accordingly, it is possible to effectively reduce deterioration of the etching performance even if the alkaline solution was cyclically used, thereby avoiding deterioration of printing resistance and fouling resistance of a planographic printing plate as a finished product.

Even in the case of adding impurities (dissimilar metal) in aluminum, or in use of a low-purity aluminum web such as an aluminum web having low purity of 99.4 wt % or less, particularly of 99.0 wt % or less, deterioration of the etching performance can be avoided, thereby greatly contributing to an application to CTP and cost reduction.

Solid matter precipitated in the alkaline solution is filtered, so as to prevent a nozzle of spraying the alkaline solution onto an aluminum web from being clogged, and also to prevent solid matter adhering to guide rollers in the treatment tank from being transferred to the aluminum web.

In the manufacturing method of the present invention, the filtering is preferably carried out by using a filter membrane having a pore size of 1 to 30 μm in the filtering step. A grain diameter of solid matter precipitated into the alkaline solution through the alkaline etching treatment is approximately in the range from 5 to 100 μm (20 μm in average), and the filtration efficiency can be enhanced by appropriately selecting the pore size of the filter membrane in the range from 1 to 30 μm. The pore size is more preferably defined in the range from 5 to 30 μm, and further more preferably in the range from 5 to 20 μm.

In the manufacturing method of the present invention, it is preferable to add abrasive as a filter aid in the alkaline solution to be filtered in the filtering step.

Solid matter precipitated into the alkaline solution through the alkaline etching treatment mainly contains hydroxides having large swelling property, and hydroxides compressed by filtering pressure encourage clogging of the filter membrane, and cause deterioration of the filtration rate. To address this disadvantage, the present inventors obtained a finding that abrasive made of extremely hard grains is added as a filter aid in the alkaline solution for the sake of a body-feed filtration, thereby significantly reducing deterioration of the filtration rate.

The additive amount of the abrasive is preferably in the range from 0.03 to 1.00 g/L, and more preferably in the range from 0.05 to 0.30 g/L. The grain diameter of the abrasive is preferably in the range from 3 to 50 μm and more preferably in the range from 6 to 45 μm in terms of the median size.

The manufacturing method of the present invention preferably includes a step of performing mechanical surface roughening on the surface of the aluminum web with the abrasive prior to the alkaline etching step, and used abrasive generated in the mechanical surface roughening step is used in the filtering step.

This is because the abrasive used in the mechanical surface roughening have grains with round edges, which prevents the abrasive from causing damages on the filter membrane, compared to unused abrasive. In addition, utilizing the abrasive used in the mechanical surface roughening allows efficient use of abrasive.

The manufacturing method of the present invention preferably includes a solid matter concentration measuring step of measuring solid matter concentration of the alkaline solution cyclically used; and a control step of controlling solid matter content of the alkaline solution to be 100 ppm or less based on the measured solid matter concentration. The more preferable solid matter content is 50 ppm or less.

The solid matter concentration may be measured such that a calibration curve of the specific gravity, the electric conductivity, the turbidity, the chromaticity, and the solid matter concentration in the alkaline solution cyclically used is prepared, and the solid matter concentration can be found based on this calibration curve.

In such a manner, it is possible to prevent the solid matter concentration from affecting the etching performance, and the filtrating step may be carried out only when the solid matter concentration affects the etching performance, thereby eliminating a redundant filtering operation and reducing the running cost.

In the manufacturing method of the present invention, it is preferable that, in the filtering step, the filtering is carried out at more than one filtering stage if the solid matter concentration is in a range from 200 to 1500 ppm.

As described above, the multiple-stage filtering enhances the filtration performance and the durability of the membrane.

For example, if there are two filtering stages, the filter membranes having a pore size of 10 to 30 μm are preferably used in the first filtering stage, and the filter membranes having a pore size from 1 μm to less than 10 μm (1 to 8 μm, for example) are preferably used in the second filtering stage.

In the manufacturing method of the present invention, the filtering step preferably includes a separating step of separating the solid matter from the filter membrane by backwashing the filter membrane; a deliquoring step of deliquoring the alkaline solution from the separated solid matter; and a returning step of returning the alkaline solution separated in the deliquoring step to the alkaline solution reservoir to recycle the alkaline solution.

This configuration reduces the amount of the wasted alkaline solution and also reduces the amount of the wasted solid matter after being dehydrated. Air-backwashing, or solution-backwashing using an alkaline solution or an acid solution may be preferably applicable to the backwashing method.

In the manufacturing method of the present invention, as aluminum purity of an aluminum material used as the aluminum web becomes lower, more solid matter is preferably removed in the filtering step.

As the aluminum purity of the aluminum material used as the aluminum web becomes lower, more solid matter is precipitated in the alkaline solution, resulting in deterioration of the etching performance.

In the manufacturing method of the present invention, the aluminum web is preferably made of low purity aluminum having aluminum purity of 99.0% or less.

The etching performance is likely to be deteriorated in the case of using a low purity aluminum web of 99.4 wt % or less, particularly of 99.0 wt % or less because more solid matter is precipitated in the alkaline solution; thus the present invention is particularly effective in such a case.

In order to attain the aforementioned object, the manufacturing apparatus of a support for a planographic printing plate according to the present invention includes at least an alkaline etching apparatus for dissolving an aluminum surface layer of an aluminum web with an alkaline solution in a surface roughening treatment apparatus for roughening a surface of the aluminum web continuously traveling. In this manufacturing apparatus, the alkaline etching apparatus includes: a circulation line for cyclically using the alkaline solution between a treatment tank for the etching and an alkaline solution reservoir; a composition concentration adjustment line for maintaining composition concentration of the alkaline solution cyclically used at a constant level; and a filtering line for filtering the alkaline solution cyclically used.

The manufacturing apparatus of the present invention includes the circulation line for cyclically using the alkaline solution, the composition concentration adjustment line for the alkaline solution, and the filtering line for the alkaline solution; thus it is possible to effectively reduce deterioration of the etching performance even if the alkaline solution is cyclically used in the alkaline etching treatment.

Even in the case of adding impurities (dissimilar metal) in aluminum, or even in use of a low-purity aluminum web such as an aluminum web having low purity of 99.4 wt % or less, particularly of 99.0 wt % or less, deterioration of the etching performance can be avoided, thereby contributing to an application to CTP and cost reduction.

Solid matter precipitated in the alkaline solution is filtered, so as to prevent a nozzle of spraying the alkaline solution onto the aluminum web from being clogged, and also to prevent solid matter adhering to guide rollers in the treatment tank from being transferred to the aluminum web.

In the manufacturing apparatus of the present invention, the filtering line preferably includes a filter aid adding device for adding abrasive as a filter aid in the alkaline solution to be filtered.

As described above, using the abrasive as the filter aid attains remarkable reduction of deterioration of the filtration rate.

The manufacturing apparatus of the present invention preferably includes a mechanical surface roughening apparatus disposed prior to the alkaline etching apparatus, the mechanical surface roughening apparatus performing mechanical surface roughening on the surface of the aluminum web with a slurry containing abrasive; and a separation-conveyance line for separating used abrasive generated in the mechanical surface roughening apparatus from the slurry, the separation-conveyance line conveying the separated abrasive to the filter aid adding device.

In such a manner, the apparatus structure for using the abrasive as the filter aid can be established.

In order to attain the above described object, the manufacturing method of a support for a planographic printing plate according to the present invention includes at least a surface roughening treatment step for roughening at least one surface of an aluminum web continuously traveling, and the surface roughening step includes: an alkaline etching step of etching the aluminum web by bringing the aluminum web into contact with an alkaline solution; and an electrolytic surface roughening step of electrochemically roughening the etched aluminum web in an acid electrolytic solution, and the method further includes an anode oxidation treatment step for performing an anode oxidation treatment on the aluminum web of which surface is roughened in the electrolytic surface roughening step in an acid solution, so as to form an anode oxidation film on the aluminum web. The electrolytic surface roughening step includes a circulation step for cyclically using the acid electrolytic solution between an electrolyzer and an electrolytic solution reservoir during adjusting composition concentration of the acid electrolytic solution; and a filtering step of filtering the acid electrolytic solution cyclically used so as to remove solid matter in the acid electrolytic solution, and or the anode oxidation treatment step includes: a circulation step for cyclically using the acid solution between a feeding tank and an acid solution reservoir, and between an electrolytic treatment tank and the acid solution reservoir during adjusting composition concentration of the acid solution; and a filtering step of filtering the acid solution cyclically used, so as to remove solid matter in the acid solution.

According to the present invention, the solid matter precipitated into the acid electrolytic solution and or the acid solution is filtered; thus it is possible to form an even roughened surface, and also to form an anode oxidation film with less defects.

The solid matter is removed through a filter membrane having a pore size of 1 μm to 10 μm in the filtering step of the electrolytic surface roughening step and or in the filtering step of the anode oxidation treatment step.

The grain diameter of solid matter dissolved and precipitated into the acid electrolytic solution is in the range from approximately 0.1 μm to 10 μm (1.5 μm in average), and the diameter of the solid matter dissolved and precipitated into the acid solution is approximately in the range from 0.1 μm to 10 μm (1.5 μm in average). Accordingly, it is possible to enhance the filtration rate by appropriately selecting the pore size of the filter membrane in the range from 1 μm to 10 μm.

It is preferable that the anode oxidation treatment step further includes a copper ion removal step of reducing copper ion concentration in the acid solution by collecting copper ions from the acid solution in the electrolytic treatment tank.

It is possible to prevent metallic copper from adhering to the aluminum web.

The filtering step of the electrolytic surface roughening step further preferably includes: a measuring step of measuring solid matter concentration of the acid electrolytic solution cyclically used; and a controlling step of ON-OFF controlling the filtering step so as to maintain solid matter content of the acid electrolytic solution at 20 ppm or less based on the measured solid matter concentration.

The solid matter concentration may be measured such that a calibration curve of the specific gravity, the electric conductivity, turbidity, the chromaticity, and the solid matter concentration in the acid electrolytic solution cyclically used is created, or a calibration curve of the specific gravity, the electric conductivity, turbidity, the chromaticity, and the solid matter concentration in the acid solution cyclically used is created, and the solid matter concentration is found based on this calibration curve.

In such a manner, it is possible to carry out the filtrating step only when the solid matter concentration affects the characteristics of the electrolytic surface roughening treatment and the characteristics of the anode oxidation treatment, thereby eliminating a redundant filtering operation and reducing the running cost.

As aluminum purity of an aluminum material used as the aluminum web becomes lower, more solid matter is preferably removed in the filtering step of the electrolytic surface roughening step and in the filtering step of the anode oxidation treatment step.

This is because as the aluminum purity of the aluminum material used in the aluminum web becomes lower, more solid matter is precipitated.

The aluminum web is preferably made of aluminum having aluminum purity of 99.4% or less, particularly 99.0% or less. The roughened surface is likely to be uneven because more solid matter is precipitated, and defects are likely to be caused on the anode oxidation film in the case of using a low purity aluminum web of 99.4 wt % or less, particularly of 99.0 wt % or less; thus the present invention is particularly effective in such a case.

In order to attain the above described object, the manufacturing apparatus of a support for a planographic printing plate according to the present invention includes an electrolytic surface roughening apparatus, and an anode oxidation treatment apparatus, and the electrolytic surface roughening apparatus includes: a circulation line for cyclically using an acid electrolytic solution between an electrolyzer and an electrolytic solution reservoir; a filtering line for filtering the acid electrolytic solution cyclically used so as to remove solid matter in the acid electrolytic solution; and a composition concentration adjustment line for adjusting composition concentration of the acid electrolytic solution, and/or the anode oxidation treatment apparatus includes: a circulation line for cyclically using an acid solution between a feeding tank and an acid solution reservoir, and between an electrolytic treatment tank and the acid solution reservoir; a filtering line for filtering the acid solution cyclically used so as to remove solid matter in the acid solution; and an adjustment line for adjusting composition concentration of the acid solution.

According to the manufacturing method and the manufacturing apparatus of a support for a planographic printing plate of the present invention, it is possible to effectively reduce deterioration of the etching performance even if the alkaline solution is cyclically used in the alkaline etching treatment, thereby avoiding deterioration of the printing resistance and the fouling resistance of a planographic printing plate as a finished product.

It is possible to effectively reduce unevenness of the roughened surface or defects on the anode oxidation film in the electrolytic surface roughening treatment and in the anode oxidation treatment in the acid etching treatment.

Even in the case of adding impurities (dissimilar metal) in aluminum, or even in use of a low-purity aluminum web such as an aluminum web having low purity of 99.4 wt % or less, particularly of 99.0 wt % or less, deterioration of the etching performance can be avoided, thereby greatly contributing to an application to CTP and cost reduction.

BRIEF DESCRIPTION OF THE DRAWINGS

FIGS. 7A to 7C are tables of explaining Example cases and Comparative examples of an alkaline etching treatment;

FIG. 8 is a table showing results from a test on an additive effect of abrasives in the alkaline etching treatment; and FIG. 9 is a table explaining Example cases and Comparative examples of an acid etching treatment.

DETAILED DESCRIPTION OF THE PREFERRED EMBODIMENTS

Hereinafter, description will be provided on a manufacturing method and a manufacturing apparatus for a support for a planographic printing plate according to the present invention with reference to the accompanying drawings.

An aluminum support for a planographic printing plate (referred to as a "support for a planographic printing plate", hereinafter) manufactured by the manufacturing method of the present invention is an aluminum web having a grained surface formed by applying a surface treatment to the surface of the aluminum web.

Figure 1:
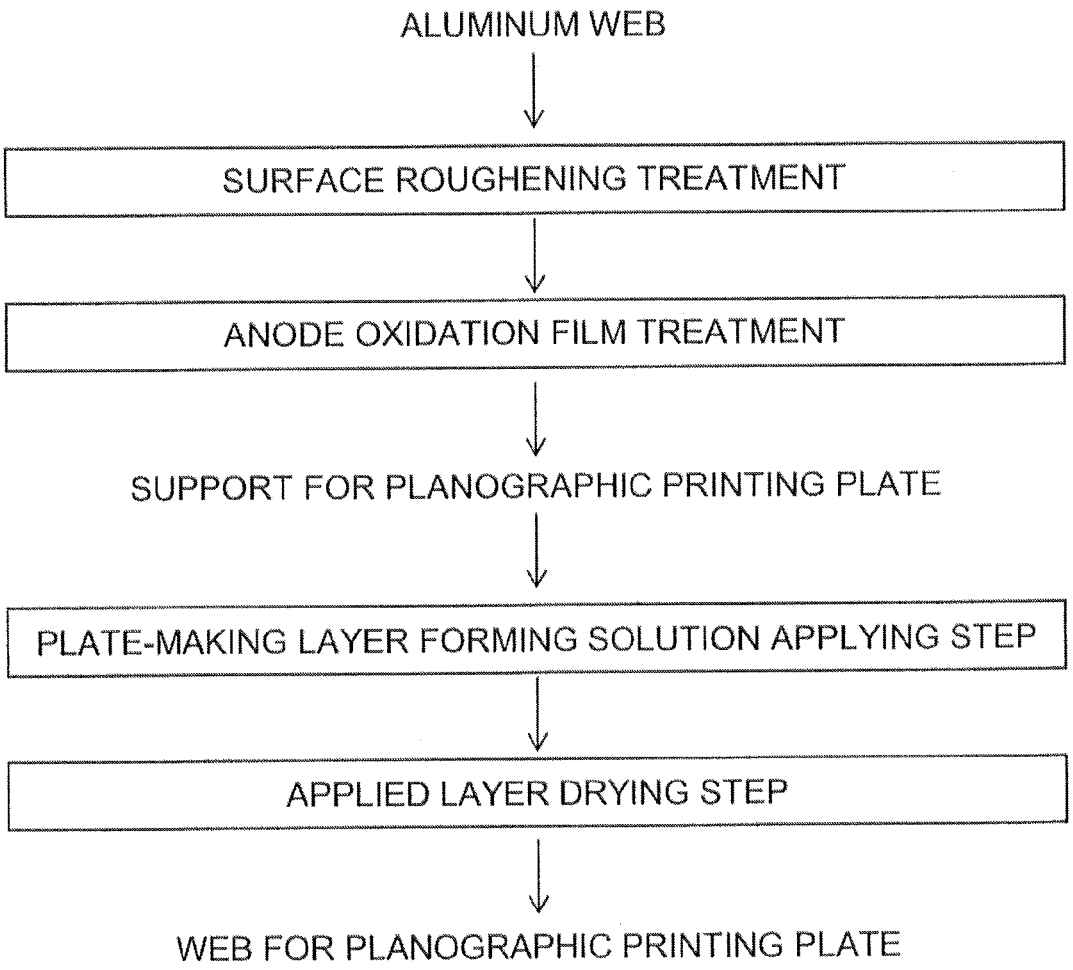
FIG. 1 is a diagram illustrating steps of manufacturing a web for use in a planographic printing plate.

As illustrated in FIG. 1, the support for a planographic printing plate is produced through a surface roughening treatment step of graining an aluminum web, and an anode oxidation treatment step of forming an anode oxidation film on the roughened surface. Then, a web for a planographic printing plate is manufactured through an application process of coating a plate-making layer forming solution such as a photosensitive layer forming solution and a heat-sensitive layer forming solution on the roughened surface of the produced support for the planographic printing plate, and also through a drying process of drying the coated layer. A well-known layer such as an over coat layer may further be applied on the coated layer. The web of the planographic printing plate manufactured in this manner is cut into a sheet in a predetermined size as a finished planographic printing plate.

Such a manufacturing apparatus of a support for a planographic printing plate is preferably constituted by a combination of various surface roughening apparatuses for graining a surface of an aluminum web and an anode oxidization apparatus for forming an anode oxidization film on the surface of the aluminum web. For example, an aluminum web continuously fed out from a reel is treated by plural kinds of surface roughening apparatuses appropriately arranged in series, and these surface roughening apparatuses include a mechanical surface roughening apparatus (in the case of brush graining, for example); an alkaline etching apparatus; a desmutting apparatus using acid; and an electrolytic surface roughening apparatus using different electrolytic solutions. In the subsequent step after this surface roughening apparatuses, an anodic oxidation apparatus is disposed so as to form an anodic oxidation film on the roughened surface.

The surface of an aluminum web resulted from the surface treatments through the above apparatus configuration has a structure that overlaps projections and recesses with at least two different intervals, thereby producing a finished planographic printing plate excellent in printing resistance and fouling resistance.

Hereinafter, detailed description will be provided on the aluminum web for use in a support for a planographic printing plate, as well as on the various surface roughening apparatuses and the anode oxidation apparatuses.

<Aluminum Web (Rolled Aluminum)>

The aluminum plate for use as the aluminum web 12 according to the present embodiment is metal containing aluminum stable in size as the main component. The aluminum plate also includes an aluminum alloy plate as described above, and these plates are generally referred to as an "aluminum plate", hereinafter.

A plastic film or paper on which aluminum alloy is laminated or deposited may also be used as an aluminum plate. In addition, as described in Japanese Examined Application Publication No. 48-18327, a composite sheet made by combing an aluminum sheet on a polyethylene-terephthalate film may be used. The aluminum plate may contain elements such as Bi and Ni, or incidental impurities.

An aluminum plate may be made of conventional materials such as aluminum plates of JIS A1050, JIS A1100, JIS A3003, JIS A3004, JIS A3005 or international registration alloy 3103A.

The method of manufacturing the aluminum plate is one of a continuous casting system and a DC casting system, and the aluminum plate manufactured by a DC casting system omitting intermediate annealing or soaking may be also used. In a final rolling process, the aluminum plate provided with recess and projections through a sandwich rolling process, a transcription process, or the like may be used. The aluminum plate may be an aluminum web that is a continuous web-like sheet or plate material, or may be a foliate sheet cut in a size corresponding to a planographic printing plate precursor to be shipped as a finished product.

The aluminum plate normally has a thickness of approximately 0.05 to 1 mm, and preferably 0.1 to 0.5 mm. The thickness of the aluminum plate may be appropriately changed in accordance with a size of a printing machine, a size of a printing plate or user's needs.

Pure aluminum or aluminum alloy having an aluminum purity of 99.5 wt % or more is normally used as the aluminum web, but the manufacturing apparatus of a support for a planographic printing plate according to the present invention is effective in the case of using aluminum web having low purity of 99.4 wt % or less, particularly of 99.0 wt % or less (98.5 wt %, for example).

<Mechanical Surface Roughening Apparatus>

Figure 2:
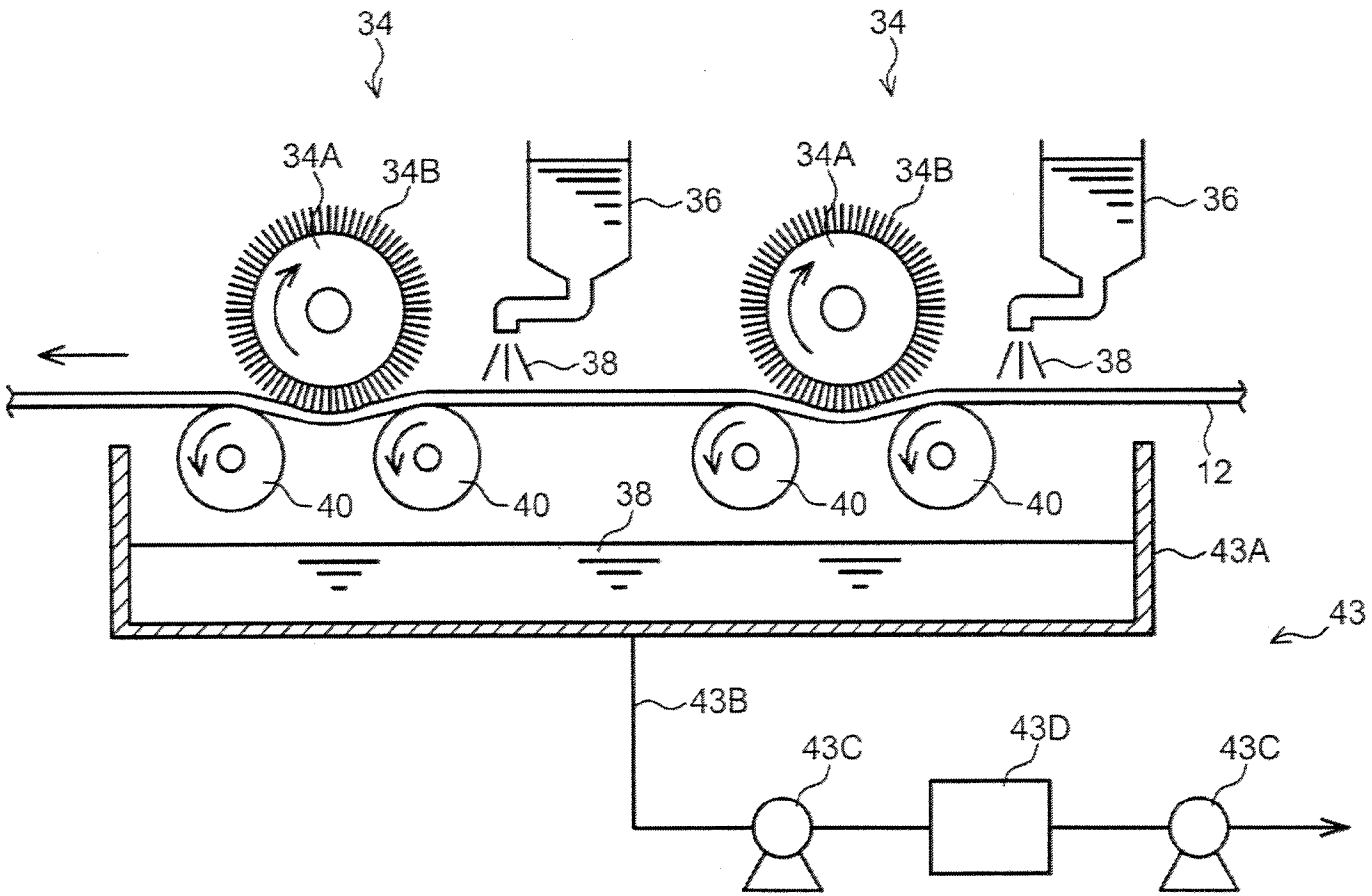
FIG. 2 is a schematic diagram illustrating brush graining as an example of a mechanical surface roughening apparatus.

FIG. 2 illustrates a bush graining system preferably used as a mechanical surface roughening apparatus.

The brush graining system normally uses roller brushes 34 in which a number of bristles 34B such as synthetic resin bristles made of synthetic resins such as Nylon (brand name), propylene, and vinyl chloride resin are implanted on a surface of each cylindrical body 34A. One or both of surfaces of the aluminum web 12 is rubbed while slurry 38 containing abrasives is being sprayed from an abrasives tank 36 onto rotating roller brushes 34. At this time, it is preferred that a pair of rollers 40, 40 are disposed with an interval substantially equal to the diameter of the roller brush 34, on the opposite side to each roller brush 34 with the aluminum web 12 located between each roller brush 34 and the pair of the rollers 40, 40, so as to push and rub the aluminum web 12 with these rollers.

On the opposite side to the roller brushes 34 with the aluminum web 12 located therebetween, a separation-conveyance line 43 is disposed so as to separate waste abrasives generated in the mechanical surface roughening apparatus from the slurry and convey this waste abrasives to an alkaline etching apparatus 42 as described later.

The separation-conveyance line 43 mainly includes a receiving pan 43A for receiving the slurry 38 fallen from the aluminum web 12, a piping 43B for connecting the receiving pan 43A to a filter aid adding device 77 of the alkaline etching apparatus 42, and a pump 43C and a separator 43D provided to the piping 43B. A centrifugal separator may be applicable to the separator 43D, for example. The abrasives are separated by the separator 43D from the slurry 38 collected in the receiving pan 43A, and thereafter, the separated abrasives are conveyed to the alkaline etching apparatus 42, where the separated abrasives are used as a filter aid. Hence, a pump capable of conveying grains may be used as the pump 43C located after the separator 43D.

Instead of using the roller brush 34 and the slurry 38, an abrasive roller whose surface has an abrasive layer may be used. In the case of using the roller brush 34, the roller brush 34 preferably has a bend elastic constant of 10,000 to 40,000 kg/cm$^2$, and more preferably 15,000 to 35,000 kg/cm$^2$, and preferably has a bristle elasticity strength of 500 g or less, and more preferably of 400 g or less. A diameter of each brush bristle 34B is normally 0.2 to 0.9 mm. A length of the brush bristle 34B may be appropriately defined depending on the outer diameter of the roller brush 34 and the diameter of the body 34A, and this is normally 10 to 100 mm.

Well-known abrasives may be used as the abrasives. The followings may be used, for example: abrasives of pumice stones, silica sands, aluminum hydroxide, alumina powders, silicon carbide, silicon nitride, volcanic ash, carborundum, or emery sands, or a combination thereof. In particular, pumice stones and silica sands are preferable as the abrasives. Particularly, silica sands are harder than pumice stones, and they hardly crack and are excellent in surface roughening efficiency. The average grain diameter of the abrasives is preferably 3 to 50 μm, and more preferably 6 to 45 μm because this range enhances surface roughening efficiency, and can narrow a graining pitch. The abrasives are suspended in the water, and are used as the slurry 38. The slurry 38 may contain, other than the abrasives, a thickening agent, a dispersant (surfactant agent, for example) or an antiseptic agent and others. The specific gravity of the slurry is preferably 0.5 to 2.

An apparatus suitable for the mechanical surface roughening treatment may include an apparatus described in Japanese Examined Application Publication No. 50-40047, for example.

The mechanical surface roughening treatment is an effective means for surface roughening because this method can produce a surface having recesses and projections with the average wavelength of 5 to 100 μm at more inexpensive cost compared to the electrochemical surface roughening treatment.

A wire brush graining system for scratching a surface of an aluminum web with metal wires, a ball graining system for graining a surface of an aluminum web using abrasive balls and abrasives, or the above described brush graining system for graining a surface of an aluminum web using a Nylon brush and abrasives as described in Japanese Patent Application Laid-Open No. 06-135175 and Japanese Examined Application Publication No. 50-40047 may be employed in the mechanical surface roughening treatment. Alternatively, such a transcription method that presses a recessed and projected surface onto an aluminum plate may be employed. Specifically, in addition to methods described respectively in Japanese Patent Application Laid-Open No. 55-74898, Japanese Patent Application Laid-Open No. 60-36195 and Japanese Patent Application Laid-Open No. 60-203496, the following methods may also be applicable: Japanese Patent Application Laid-Open No. 06-55871 performing transcription several times, and Japanese Patent Application No. 04-204235 (Japanese Patent Application Laid-Open No. 06-024168) having an elastic surface.

In addition, the following methods may also be applicable: a method of repetitively performing transcription using transcription rollers having minute recesses and projections etched by electric discharge machining, shot blasting or laser or plasma etching; and a method of bringing a surface having recessed and projections formed by coating fine grains thereon into contact with the aluminum plate and applying pressure on the aluminum plate several times, so as to repetitively transcribe the recess and projection patterns corresponding to an average diameter of fine grains onto the aluminum web 12 several times. As the method of applying fine recesses and projections onto the transcription roller, the following conventional methods may be applicable, as described in Japanese Patent Application Laid-Open No. 03-8635, Japanese Patent Application Laid-Open No. 03-66404, and Japanese Patent Application Laid-Open No. 63-65017. Fine grooves may be formed on a surface of the transcription roller by cutting the roller surface in two directions by means of a die, a cutting tool, or laser, thereby forming rectangular recesses and projections on the roll surface. This roll surface may further be applied with a conventional etching treatment so that the formed rectangular recesses and projections have round edges. In order to enhance hardness of the roll surface, a treatment such as tempering and solid chrome plating may be applied. As the mechanical surface roughening treatment, methods described in Japanese Patent Application Laid-Open No. 61-162351, Japanese Patent Application Laid-Open No. 63-104889, and others may also be applicable. In the present invention, the above described methods may be used in combination if taking account of productivity and the like. Such a mechanical surface roughening treatment is preferably carried out prior to an electrochemical surface roughening treatment.

[Alkaline Etching Apparatus]

Figure 3:
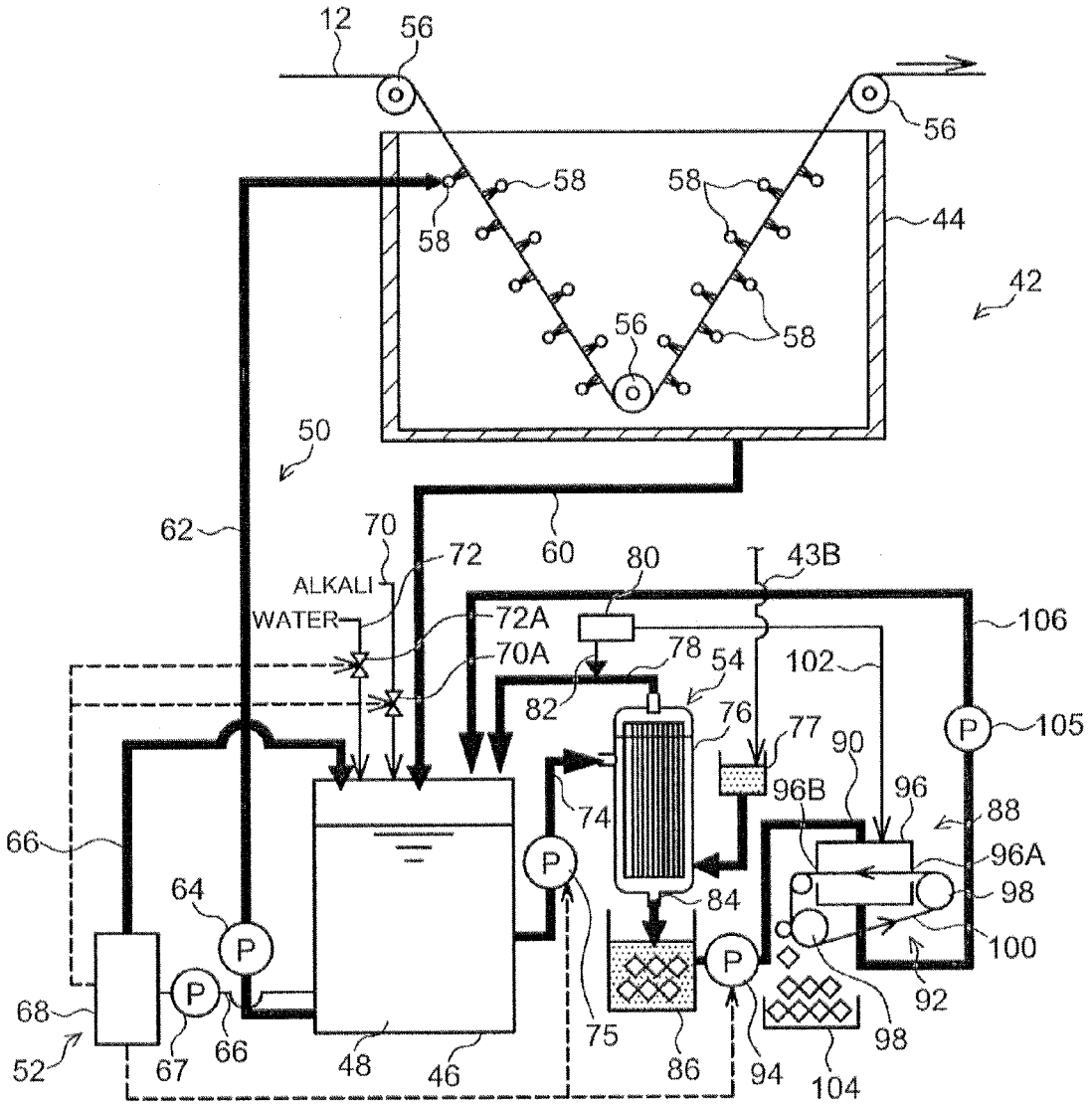
FIG. 3 is a schematic diagram illustrating an example of an alkaline etching apparatus.

FIG. 3 illustrates the overall configuration of the alkaline etching apparatus 42.

As illustrated in FIG. 3, the alkaline etching apparatus 42 includes a treatment tank 44 for performing the etching treatment, a circulation line 50 for cyclically using an alkaline solution 48 between the treatment tank 44 and an alkaline solution reservoir 46, a composition concentration adjustment line 52 for maintaining the composition concentration of the alkaline solution 48 cyclically used at a constant level, and a filtering line 54 for filtering the alkaline solution 48 cyclically used.

Figure 4:
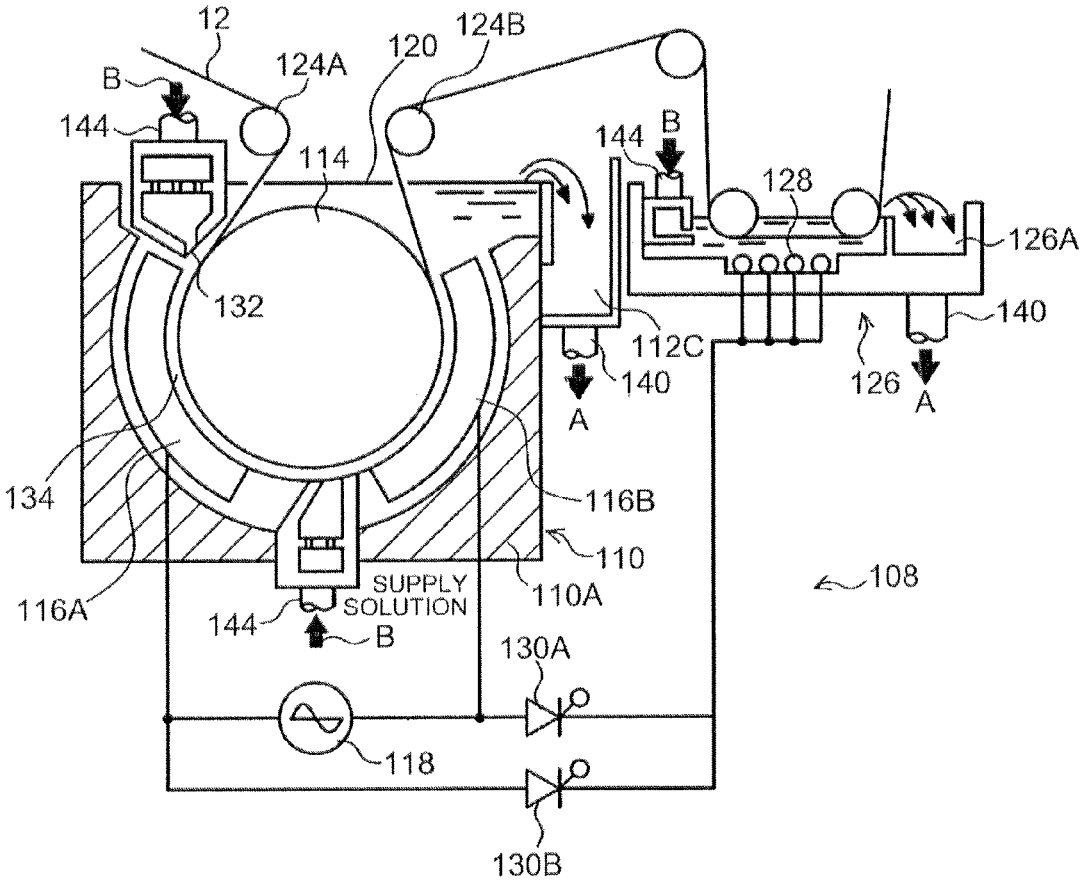
FIG. 4 is a schematic diagram illustrating an example of an electrochemical surface roughening apparatus.
Figure 4:
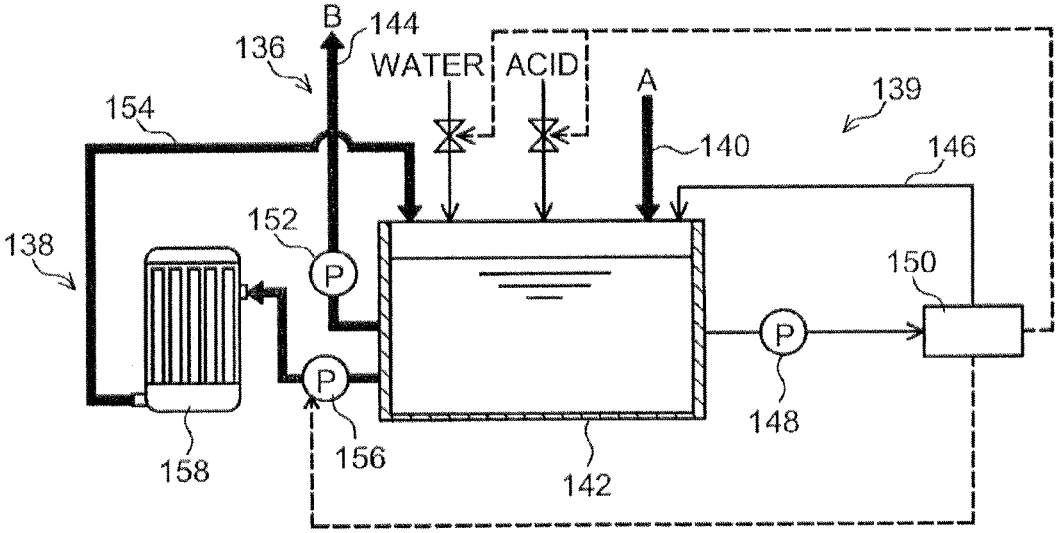

The plural guide rollers 56 are arranged in a V shape in the treatment tank 44. In this configuration, the aluminum web 12 continuously traveling enters the treatment tank 44, and then exits the treatment tank 44. In the treatment tank 44, plural nozzles 58, 58 are disposed along the traveling passage of the aluminum web 12 so as to spray the alkaline solution 48 onto the surfaces of the aluminum web 12. In FIG. 4, the alkaline solution 48 is sprayed onto the surfaces of the aluminum web 12, but the aluminum web 12 may be soaked in the alkaline solution 48, and moved in the treatment tank 44, instead.

A first piping 60 is disposed from the bottom of the treatment tank 44 to the upper portion of the alkaline solution reservoir 46, and a second piping 62 is disposed from the side face of the alkaline solution reservoir 46 to each nozzle 58. In FIG. 3, the second piping 62 is illustrated to be connected to only one nozzle 58, but the second piping 62 is actually connected such that the alkaline solution 48 is supplied for each nozzle 58.

The concentration of the alkaline solution 48 supplied from each nozzle 58 may be defined depending on the etching rate, and this concentration is preferably 1 to 50 mass %, and more preferably 10 to 35 mass %. If aluminum ions are dissolved in the alkaline solution, the concentration of the aluminum ions is preferably 0.01 to 10 mass %, and more preferably 3 to 8 mass %. The temperature of the alkaline solution is preferably 20 to 90° C. The treatment time is preferably 1 to 120 seconds.

The second piping 62 is provided with a supply pump 64. This configuration establishes the circulation line 50 for cyclically using the alkaline solution 48 between the treatment tank 44 and the alkaline solution reservoir 46.

A third piping 66 is disposed from the side face of the alkaline solution reservoir 46 to the upper portion of this reservoir, and a pump 67 and a measurement device 68 are provided at the middle of the third piping 66, so as to continuously measure alkaline characteristics that vary depending on the composition of the alkaline solution 48 stored in the alkaline solution reservoir 46. In addition, the alkaline solution reservoir 46 is provided with a first supplemental piping 70 for supplementing alkali (such as sodium hydroxide) at a high concentration (35 mass %, for example) into the alkaline solution reservoir 46, and a second supplemental piping 72 for supplementing water into the alkaline solution reservoir 46, and valves 70A, 72A are also provided to the supplemental piping 70 and the supplemental piping 72, respectively. This configuration establishes the composition concentration adjustment line 52 of the alkaline solution 48.

The measurement device 68 measures the specific gravity and the electric conductivity of the alkaline solution 48, and controls the valves 70A, 72A of the first supplemental piping 70 and the second supplemental piping 72, respectively based on the measurement result, so as to maintain the composition concentration of the alkaline solution 48 cyclically used at a constant level.

As illustrated in FIG. 3 of Japanese Patent Application Laid-Open No. 2004-066650 described as the prior art, there is a close relationship between the specific gravity and the electric conductivity of the alkaline solution 48, and the alkali concentration and the aluminum ion concentration of the alkaline solution 48. Accordingly, it is possible to adjust the alkali concentration and the aluminum ion concentration of the alkaline solution at a constant level by measuring specific gravity and the electric conductivity of the alkaline solution, and adding water and high concentration alkali through the first supplemental piping 70 and the second supplemental piping 72. The alkali concentration and the aluminum ion concentration should be adjusted because they affect the hole diameter distributions of pits (holes) on a roughened surface.

A fourth piping 74 is extendingly provided from the side face of the alkaline solution reservoir 46 to an inlet of the filtering apparatus 76, and a pump 75 is provided to the fourth piping 74. Then, the alkaline solution 48 filtered through the filtering apparatus 76 is returned from an outlet of the filtering apparatus 76 through a fifth piping 78 to the upper portion of the alkaline solution reservoir 46. The filter aid adding device 77 for adding a filter aid to the filtering apparatus 76 is provided in the vicinity of the filtering apparatus 76. A piping 43B is extendingly disposed to be extended from the receiving pan 43A of the aforementioned mechanical surface roughening apparatus to the filter aid adding device 77. In the present embodiment, used abrasives discharged from the mechanical surface roughening apparatus are reused from the filter aid adding device 77, but new abrasives may be used, instead.

A first air piping 82 is connected to the middle of the fifth piping 78 for the purpose of introducing compressed air from a compressor 80. In this configuration, when the operation of the filtering apparatus 76 is stopped, and the compressor 80 is activated, compressed air is supplied into the filtering apparatus 76, so as to air-backwash the filter membranes that is a filtering material. Specifically, solid matters adhering to the filter membranes come off and fall down to the bottom of the filtering apparatus 76. Although not shown in the drawing, when the air-backwashing is performed, a valve (not shown) disposed in the vicinity of the alkaline solution reservoir 46 of the fifth piping 78 is closed.

A discharge port 84 having an ON-OFF valve for discharging solid matters fallen on the bottom is provided on the bottom of the filtering apparatus 76, and this ON—OFF valve is opened so as to discharge solid matters containing the alkaline solution 48 from the filtering apparatus 76 into the receiving pan 86. This configuration establishes the filtering line 54 of the alkaline solution 48.

A filter membrane system using filter membranes of filter clothes or hollow fiber membranes as a filtering material may be preferably applicable to the filtering apparatus 76; but the present invention is not limited to this system, and any system or method capable of efficiently filtering solid matters precipitated in the alkaline solution 48 may be applicable, and various systems or methods using cartridges, wire meshes, a filter aid, grains, fibers or magnetic separation may be employed.

In alkaline etching, grain diameters of solid matters precipitated from the aluminum web 12 into the alkaline solution 48 are distributed in the range from 5 to 100 μm, and the average grain diameter is approximately 20 μm. Therefore, in a filter membrane system, it is preferable that the pore size of the filter membranes is appropriately selected in the range from 1 to 30 μm. A preferable range of the pore size is in the range from 5 to 30 μm, and further more preferably in the range from 5 to 20 μm.

Solid matters chiefly include hydroxides of trace metals (Si, Fe, Cu, Mn, Mg, Zn, etc.) contained in the aluminum web 12.

It is preferable to include a solid matter concentration measurement means for measuring the solid matter concentration of the alkaline solution 48 cyclically used, and a control means for controlling the filtering apparatus 76 based on the measured solid matter concentration such that the solid matter content of the alkaline solution becomes 100 ppm or less in order to avoid deterioration of the etching performance. The more preferable solid matter content is 50 ppm or less. Specifically, the solid matter content in the alkaline solution cyclically used should be maintained at the concentration of 100 ppm or less.

FIG. 3 illustrates an example of using the measurement device 68 of the composition concentration adjustment line 52 as the control means, and the solid matter concentration of the alkaline solution is found based on at least one of the measurement results of the specific gravity and the electric conductivity measured on the measurement device 68. Specifically, a calibration curve of the specific gravity and the electric conductivity relative to the solid matter concentration is prepared, and the solid matter concentration is found based on this calibration curve. The measurement device 68 switches on and off the pump 75 of the filtering line 54 based on the measured solid matter concentration, so as to control the solid matter content of the alkaline solution 48 cyclically used to be 100 ppm or less.

Alternatively, a calibration curve of turbidity and chromaticity relative to the solid matter concentration of the alkaline solution 48 cyclically used may be prepared so as to find the solid matter concentration of the alkaline solution 48, instead of using the specific gravity and the electric conductivity.

For example, in order to find the solid matter concentration using the turbidity, the turbidity is maintained at 150 (NTU) or less, thereby maintaining the solid matter content of the alkaline solution at 100 ppm or less. It is possible to maintain the solid matter content of the alkaline solution at 50 ppm or less by maintaining the turbidity at 80 (NTU) or less.

If a low purity aluminum plate having aluminum purity of 98.65% as the aluminum web 12, and the alkaline etching is carried out at three stages, the precipitation of solid matters is 200 ppm/hr. on the alkaline etching apparatuses at the first and the second etching stages. The precipitation of solid matters is 30 ppm/hr. on the alkaline etching apparatus in the third alkaline etching stage.

If the aluminum web 12 having a low aluminum concentration is used, the solid matter concentration reaches a level to cause bad influences on the etching performance through one-hour cyclic use of the alkaline solution. The aluminum web 12 having low purity contains more trace metals (Si, Fe, Cu, Mn, Mg, Zn, etc.) as aforementioned than the aluminum web 12 having high purity, so that more solid matters are precipitated into the alkaline solution through the alkaline etching.

If the aluminum web 12 having low purity is used, more solid matters should be removed in the alkaline solution; thus it is particularly effective to employ the alkaline etching apparatus 42 equipped with the filtering apparatus 76. The alkaline etching apparatuses 16 and 18 are required to remove more solid matters on the filtering apparatus 76, compared to that of the alkaline etching apparatus 20.

In the case of removing more solid matters, if the solid matter concentration in the alkaline solution is in the range from 200 to 1500 ppm, for example, the filter membranes are likely to be clogged and the filtration rate is also likely to be deteriorated for a shorter time. In this case, it is preferable to add abrasives as a filter aid from the filter aid adding device 77 into the alkaline solution 48.

The kind of the abrasives used as the filter aid is the same as that of the abrasives used in the slurry 38, as explained in the description regarding the mechanical surface roughening apparatus. Pumice stones and silica sands are particularly preferable among various kinds of the abrasives. The preferable composition of pumice stones as the filter aid is as follows:

silica (silicic acid: $SiO_2$): 70 to 80 mass %
alumina ($Al_2O_3$): 10 to 20 mass %
iron oxide ($Fe_2O_3$): 3 mass % or less
other components: the rest of 100 mass %

The grain diameter of the abrasives is preferably in the range from 3 to 5 μm and more preferably in the range from 6 to 45 μm in terms of the median size. The median size of the abrasives has a close relation with the filtration rate, and the abrasives having a median size in the range from 3 to 50 μm attains an excellent effect to reduce deterioration of the filtration rate. The abrasives having a median size in the range from 3 to 50 μm also attains an excellent release characteristics of coming off from the filtering material (filter membranes).

The grain diameter distributions of the abrasives are preferably in the range from 1 to 200 μm, and more preferably in the range from 5 to 100 μm.

The additive amount of the abrasives into the alkaline solution 48 is preferably in the range from 0.03 to 1.00 g/L, and more preferably in the range from 0.05 to 0.30 g/L. With the additive amount of the abrasives in the range from 0.03 to 1.00 g/L, it is possible to maintain the effect to reduce deterioration of the filtration rate between a relatively significant level and significant level, and also reduce the sediment amount of the abrasives on the filter membranes, so that the cleaning frequency of the filter membranes can be reduced.

New abrasives may be used as the abrasives for use as the filter aid, but it is more preferable that abrasives used in the mechanical surface roughening apparatus is reused, as aforementioned. This is because the abrasives used in the mechanical surface roughening apparatus have grains with round edges, which prevents the abrasives from causing damages on the filter membranes. The abrasives having round grains secure more gaps between grains of the abrasives accumulated on the filter membranes, thereby reducing clogging due to filtering cake layers made of mixture of solid matters and the abrasives. This also contributes to the effective utilization of the abrasives.

In this case, common filter aid such as diatomaceous soil or pearlite attains the effect to reduce deterioration of the filtration rate to some extent, but abrasives harder than common filter aids can be expected to attain more significant enhancement of this effect. Diatomaceous soil or pearlite exhibits solubility relative to the alkaline solution in an alkaline etching condition where the concentration of the alkaline solution is 20 to 35 mass % and the temperature of the alkaline solution is 50 to 80° C. This may cause bad influences on the alkaline etching performance. To the contrary, the abrasives of the aforementioned kinds have smaller solubility relative to the alkaline solution than diatomaceous soil and pearlite, which scarcely cause bad influences on the alkaline etching performance.

If the abrasives are used as the filter aid for filtering solid matters in the alkaline solution 48, filtering cake that is a mixture of the solid matters and the abrasives is formed on the filter membranes. The abrasives in the filtering cake is hard, so that the filtering cake is hard to be compressed even if high filtering pressure is applied, thereby readily securing gaps through which the alkaline solution passes. Accordingly, it is possible to reduce deterioration of the filtration rate even in the filtering operation for a long time. In this case, the cycle of filtering the alkaline solution through the filtering apparatus 76 is not limited to once, and the alkaline solution may be cyclically filtered through the filtering apparatus 76 several times by means of the pump 75. Particularly, no filtering cake having a sufficient thickness is formed yet at the early stage of the filtering operation, so that it is preferable to perform the cyclic filtering several times.

Although not shown in the drawing, if large amount of solid matters should be removed as described above, and the solid matter concentration of the alkaline solution is in the range from 200 to 1500 ppm, it may be preferable to arrange the plural filtering apparatuses 76 in series in the filtering line 54, so as to carry out the filtering operation at several stages. In this arrangement of the filtering apparatuses, it is preferable that the filtering apparatus 76 at an upstream has a greater pore size of the filter membranes and the filtering apparatus 76 at a lower downstream has a smaller pore size thereof. For example, if there are two filtering stages, the filtering at the first stage is carried out using filter membranes having a pore size of 10 to 30 μm, and the filtering at the second stage is carried out using filter membranes having a pore size from 1 μm to less than 10 μm (1 to 8 μm, for example). More preferably, the filtering at the first stage may be carried out using filter membranes having a pore size of 10 to 20 μm, and the filtering at the second stage may be carried out using filter membranes having a pore size of 5 μm to less than 10 μm (5 to 8 μm, for example).

As described above, the alkaline etching apparatus 42 includes not only the composition concentration adjustment of the alkaline solution 48 cyclically used, but also the filtering of solid matters precipitated from the aluminum web 12 into the alkaline solution through the alkaline etching treatment on the filtering apparatus 76. This configuration effectively reduces deterioration of the etching performance even if the alkaline solution 48 is cyclically used in the alkaline etching treatment. Hence, it is possible to effectively prevent deterioration of printing resistance and fouling resistance of a planographic printing plate as a finished product.

Particularly, the etching performance is not deteriorated even if using the aluminum web 12 having low purity, which significantly contributes to cost reduction for manufacturing a support for a planographic printing plate.

It is preferable that the filtering line 54 is provided with a deliquoring line 88 for deliquoring the alkaline solution 48 from the filtered solid matters, as illustrated in FIG. 3.

Specifically, a sixth piping 90 is extendingly disposed from the receiving pan 86 to a deliquoring apparatus 92, and the sixth piping 90 is provided with a pump 94 for feeding the solid matters in the receiving pan 86 to the deliquoring apparatus 92. The deliquoring apparatus 92 may be an apparatus of any kind capable of removing the alkaline solution 48 from the solid matters, and a belt-type deliquoring apparatus may be preferably used, for example.

The belt-type deliquoring apparatus may be configured such that an endless non-woven web 100 is extendingly arranged between a pair of rollers 98 and 98 that are respectively disposed at an entrance 96A and at an exit 96B of a long horizontal deliquoring container 96, and the endless non-woven web 100 rotationally travels between the pair of the rollers 98 and 98. In addition, a second air piping 102 is extendingly disposed from the ceiling of the deliquoring container 96 to the aforementioned compressor 80. In this configuration, the alkaline solution 48 in the solid matters conveyed on the endless non-woven web 100 passes through the endless non-woven web 100 by gravity and compressed air supplied from the compressor, and is collected on the bottom of the deliquoring container 96. Consequently, the alkaline solution 48 is removed from the solid matters, and the solid matters from which the alkaline solution is removed are dropped down into a solid matter receiving pan 104 disposed below the exit 96B.

The alkaline solution 48 collected on the bottom of the deliquoring container 96 is returned through a seventh piping 106 having a pump 105 to the alkaline solution reservoir 46. This configuration establishes the deliquoring line 88 for recycling the alkaline solution remaining in the solid matters.

This deliquoring line 88 preferably performs the deliquoring such that the alkaline content in the solid matters becomes 80 mass % or less, and preferably 60 mass % or less.

As described above, the present embodiment employs the composition concentration adjustment of the alkaline solution 48 cyclically used as well as the filtering of the alkaline solution 48, thereby effectively reducing deterioration of the etching performance even if the alkaline solution 48 is cyclically used in the alkaline etching treatment. Particularly, the etching performance can be prevented from being deteriorated even in the case of using the aluminum web 12 having low purity; thus it is possible to avoid deterioration of printing resistance and fouling resistance of a planographic printing plate as a finished product.

A preferred embodiment of the alkaline etching treatment will be described, hereinafter.

In the case of performing no mechanical surface roughening treatment prior to the alkaline etching treatment, the etching rate is preferably 0.1 to 10 $g/m^2$, and more preferably 1 to 5 $g/m^2$. If the etching rate is less than 0.1 $g/m^2$, rolling oils, stains or natural oxide films may remain on the surface, which may hinder even pit formation in the subsequent electrolytic surface roughening treatment, resulting in unevenness in the roughened surface. If the etching rate is from 1 to 10 $g/m^2$, rolling oils, stains or natural oxide films are sufficiently removed from the surface. Etching rate exceeding the above range results in economical disadvantages.

In the case of performing the mechanical surface roughening prior to the alkaline etching, the etching rate is preferably 3 to 20 $g/m^2$, and more preferably 5 to 15 $g/m^2$. If the etching rate is less than 3 $g/m^2$, recesses and projections formed through the mechanical surface roughening treatment or the like cannot be smooth, which may result in uneven pit formation in the subsequent electrolytic treatment. In addition, stains may become deteriorated during printing. If the etching rate exceeds 20 $g/m^2$, the recess and projection structure may be lost.

The alkaline etching treatment carried out immediately after the mechanical surface roughening treatment has purposes of dissolving smut generated in the acid electrolytic solution, as well as dissolving edges of pits formed through the electrolytic surface roughening treatment. Pits formed through the electrolytic surface roughening treatment become different depending on the kind of the electrolytic solution, so that the optimum etching rate is also varied, but the etching rate in the alkaline etching treatment carried out after the electrolytic surface roughening treatment is preferably from 0.1 to 5 $g/m^2$. In the case of using a nitric acid electrolytic solution, the etching rate should be greater than that in the case of using a hydrochloric acid electrolytic solution. If the electrolytic surface roughening treatment is carried out several times, the alkaline etching treatment may be carried out after each electrolytic surface roughening treatment, if necessary.

Examples of alkali used for the alkaline solution 48 may include caustic alkali and alkaline metal, for example. Specifically, examples of caustic alkali may include sodium hydroxide, potassium hydroxide, for example. Examples of alkaline metal may include: alkali metal silicate such as sodium metasilicate, sodium silicate, potassium metasilicate, and potassium silicate; alkali metal carbonate such as sodium carbonate and potassium carbonate; alkali metal aluminate such as sodium aluminate, and potassium aluminate; alkali metal aldonate such as sodium gluconate, and potassium gluconate; and alkali metal hydrogen phosphate such as disodium hydrogenphosphate, dipotassium phosphate, trisodium phosphate, and tripotassium phosphate, for example. Particularly, because of high etching speed and inexpensive cost, it is preferable to use a caustic alkali solution, and a solution containing both caustic alkali and alkali metal aluminate. In particular, it is preferable to use a solution of sodium hydroxides.

The alkali condition such as the concentration of the alkaline solution 48 is as aforementioned.

A method of bringing the aluminum web 12 into contact with the alkaline solution 48 includes a method of passing the aluminum web 12 through a tank containing the alkaline solution 48 therein, a method of soaking the aluminum web 12 in the tank containing the alkaline solution 48 therein, and a method of spraying the alkaline solution 48 onto the surfaces of the aluminum web 12.

<Electrochemical Surface Roughening Apparatus>

FIG. 4 is a cross sectional schematic diagram illustrating an example of an electrochemical surface roughening apparatus equipped with a radial type alternating current electrolyzer.

As illustrated in FIG. 4, the electrolytic surface roughening apparatus 108 includes an electrolyzer body 110 having an electrolyzer 110A for storing the acid electrolytic solution thereinside, and a feed roller 114 disposed in the electrolyzer 110A such that the feed roller 114 is rotatable around an horizontally extending axial line, so as to feed the aluminum web 12 in a continued web shape in the arrow direction, that is, in the left to right direction in FIG. 4.

The inner wall of the electrolyzer 110A is formed in an approximately cylindrical shape surrounding the feed roller 114, and half-cylindrical electrodes 116A and 116B are disposed on the inner wall of the electrolyzer 110A with the feed roller 114 disposed therebetween. Each electrode 116A, 116B is divided into plural small electrodes (not shown) in the circumferential direction, and an insulating layer (not shown) is disposed between each adjacent small electrode. Each small electrode may be made of graphite or metal, and each insulating layer may be made of vinyl chloride resin or the like, for example. The insulating layer preferably has a thickness of 1 to 10 nm. Not shown in FIG. 4, each small electrode of both the electrodes 116A and 116B is connected to an AC power source 118.

The AC power source 118 has a function to supply an alternating waveform current for the electrodes 116A and 116B. An example of the AC power source 118 may include a sine wave generating circuit using an induction regulator and a transformer so as to provide current-voltage regulation to a commercial alternating current; and a thyristor circuit for generating a trapezoidal wave current or a square wave current from a DC current obtained by means of rectifying a commercial alternating current, or the like.

An aperture 120 is provided on the upper portion of the electrolyzer 110A, so that the aluminum web 12 is led in and out through this aperture during the AC electrolytic surface roughening treatment. An acid electrolytic solution supplemental piping 112 for supplementing an acid electrolytic solution into the electrolyzer 110A is disposed in the vicinity of the downstream end of the electrode 116B at the aperture 120. A nitric acid solution, a hydrochloric acid solution, or the like may be used as the acid electrolytic solution.

There are provided in the vicinity of the aperture 120 above the electrolyzer 110A a group of upstream guide rollers 124A for guiding the aluminum web 12 into the electrolyzer 110A, and a group of downstream guide rollers 124B for guiding the aluminum web 12 outside the electrolyzer 110A after the electrolytic surface roughening treatment inside the electrolyzer 110A.

An overflow tank 112C is disposed at the downstream of the electrolyzer 110A in the electrolyzer body 110. The overflow tank 112C temporarily stores the acid electrolytic solution flowing over from the electrolyzer 110A, so as to maintain the liquid surface of electrolyzer 110A at a constant level.

An auxiliary electrolyzer 126 is disposed at the downstream of the electrolyzer 110A in the electrolyzer body 110. The auxiliary electrolyzer 126 has a flat bottom surface shallower than the electrolyzer 110A. Plural cylindrical auxiliary electrodes 128 are provided on this bottom surface.

The auxiliary electrodes 128 are preferably made of metal having high corrosion resistance such as silver, or ferrite, and the auxiliary electrodes 128 may have a plate shape.

The auxiliary electrodes 128 are connected parallel to the electrode 116B on the electrode 116B side relative to the AC power source 118, and a thyristor 130A is connected between the electrode 116B and the electrode 116B such that the current is supplied in the direction from the line connected to the electrode 116B relative to the AC power source 118 to the auxiliary electrodes 128 at the time of ignition.

The line connected to the electrode 116A relative to the AC power source 118 is also connected to the auxiliary electrodes 128 through a thyristor 130B. The thyristor 130B is connected such that the current is supplied in the direction from the line connected to the electrode 116A relative to the AC power source 118 to the auxiliary electrodes 128 at the time of ignition.

If any one of the thyristors 130A and 130B is ignited, an anode current flows to the auxiliary electrodes 128. Hence, it is possible to control not only a current value of the anode current flowing to the auxiliary electrodes 128, but also the ratio Qc/Qa of the quantity of electricity Qc flowing when the aluminum web 12 is in the cathodic state relative to the quantity of electricity Qa flowing when the aluminum web 12 is in the anode state.

The alternating current frequency is not limited to a specific value, but it is preferable in the range from 40 to 120 Hz, more preferable in the range from 40 to 80 Hz, further more preferable in the range from 50 to 60 Hz.

In FIG. 4, the reference numeral 132 designates a slit, and the reference numeral 134 designates an electrolytic solution passage. A supply port of the electrolytic treatment solution may be provided at a lower portion of the electrolyzer 110A other than to the acid electrolytic solution supplemental piping 122.

The electrolytic surface roughening apparatus 108 is provided with a circulation line 136 for cyclically using the acid electrolytic solution, a filtering line 138 for filtering the acid electrolytic solution cyclically used, and a composition concentration adjustment line 139 for adjusting the composition concentration of the acid electrolytic solution.

Specifically, discharge pipings 140 are provided to the overflow tank 112C accepting the acid electrolytic solution flown over from the electrolyzer 110A, and also to a spillover tank 126A accepting the acid electrolytic solution flown over from the auxiliary electrolyzer 126. These discharge pipings 140 are extendingly disposed to the upper portion of the electrolytic solution reservoir 142. In FIG. 4, the reference character A of the discharge piping 140 is connected to the reference character A designating the discharge piping 140 extending to the electrolytic solution reservoir 142.

A circulation piping 146 is extendingly disposed from the middle of the side face of the electrolytic solution reservoir 142 to the upper portion of the electrolytic solution reservoir 142. There are provided, in the middle of the circulation piping 146, a pump 148 and a measurement device 150 for continuously measuring electrolytic solution characteristics that vary depending on the composition of the acid electrolytic solution stored in the electrolytic solution reservoir 142.

An acid supplemental piping for supplementing high concentration acid (such as hydrochloric acid and nitric acid) as well as a water supplemental piping for supplementing water are provided to the electrolytic solution reservoir 142, and each supplemental piping is provided with a valve. The valve of each supplemental piping is controlled to be open and closed based on measurement results on the measurement device 150. The composition concentration adjustment line 139 for maintaining the composition concentration of the acid electrolytic solution at a constant level is established.

A supply piping 144 extends from the lower portion of the side face of the electrolytic solution reservoir 142 to the respective electrolytic solution supply ports of the electrolyzer 110A and the auxiliary electrolyzer 126. Specifically, in FIG. 4, the reference character B designating the supply piping 144 is connected to the reference characters B designating the respective electrolytic solution supply ports of the electrolyzer 110A and the auxiliary electrolyzer 126. A pump 152 is disposed to the supply piping 144. This configuration establishes the circulation line 136 for cyclically using the acid electrolytic solution.

The electrolytic solution reservoir 142 is provided with a circulation piping 154, and a pump 156 and a filtering apparatus 158 are provided in the middle of the circulation piping 154. This configuration establishes the filtering line 138 for filtering acid electrolytic solution. Although an intake port of the supply piping 144 is disposed to the electrolytic solution reservoir 142, the circulation piping 154 of the filtering apparatus 158 may be used as the supply piping, and connected to the reference character B designating the electrolytic solution supply port, instead.

A filtering system using filter membranes may be preferably employed in the filtering apparatus 158, as similar to the alkaline etching apparatus 42. In the electrolytic surface roughening treatment, the grain diameter of solid matters dissolved and precipitated from the aluminum web 12 into the acid electrolytic solution is in the range from approximately 0.1 μm to 10 μm (1.5 μm in average), which is smaller than that in the alkaline etching treatment.

Accordingly, the pore size of the filter membranes is preferably selected from the range from 1 μm to 10 μm. In the electrolytic surface roughening treatment, the amount of solid matters dissolved from the aluminum web 12 into the acid electrolytic solution is approximately as small as 3 ppm/hr., so that a simple cartridge type filtering apparatus may be applicable to the filtering apparatus 158.

It is preferable to provide a solid matter concentration measurement means for measuring the solid matter concentration of the acid electrolytic solution cyclically used, and a control means for ON-OFF controlling the filtering apparatus 158 based on the measured solid matter concentration such that the solid matter content becomes 20 ppm or less.

FIG. 4 illustrates the case of using the measurement device 150 as the control means, in which the solid matter concentration of the acid electrolytic solution is calculated based on at least one of the measurement results of the specific gravity and the electric conductivity, which are measured on the measurement device 150. Specifically, a calibration curve of the specific gravity and the electric conductivity relative to the solid matter concentration is created, and the solid matter concentration is found based on this calibration curve. Alternatively, the solid matter concentration may be found based on the turbidity and the chromaticity of the acid electrolytic solution, instead of using the specific gravity and the electric conductivity.

For example, the turbidity is preferably maintained at 50 (NTU) or less, and more preferably at 30 (NTU) or less.

If the aluminum web 12 having low purity is used, more solid matters should be removed from the acid electrolytic solution.

Not shown in the drawing, it may be preferable to arrange the plural filtering apparatuses 158 in series in the filtering line 138 so as to perform the filtering operation in several stages. In this case, it is preferable that the filtering apparatus 158 at an upstream of the line has a greater pore size of the filter membranes and the filtering apparatus 158 at a lower downstream of the line has a smaller pore size thereof. For example, in the two-stage filtering, filtering at the first stage is carried out using the filter membranes having a pore size of 5 to 10 μm, and filtering at the second stage is carried out using the filter membranes having a pore size of 1 to 5 μm. In this case, the pore size of the filter membranes in the second filtering stage is defined to be smaller than that of the filter membranes in the first filtering stage.

The filtered solid matters are preferably dehydrated at the water content of 80% or less, and more preferably at the water content of 60% or less, which results in reduction of waste. The recycle of the dehydrated acid electrolytic solution reduces supplemental amount of new liquid or discharge amount of liquid, which is advantageous in economic efficiency.

In the electrochemical surface roughening treatment, it is preferable to remove ions (such as copper ion, manganese ion, magnesium ion, and zinc ion) dissolved in the acid electrolytic solution as well as removal of the solid matters. For example, an ion removal apparatus may be provided at a location at the downstream of the electrolyzer body 110 and the auxiliary electrolyzer 126 and at the upstream of the electrolytic solution reservoir 142. The ion removal apparatus may include a reservoir, and a metal piece that is placed in the reservoir and has an ionization tendency greater than that of a target ion to be removed, so as to precipitate the target ion onto the metal piece.

Alternatively, it is possible to precipitate the target ion by using a metal piece having an ionization tendency greater than that of the target ion as the cathode and an insoluble metal piece as the anode.

An ion exchanger may be provided as the ion removal apparatus so as to remove unnecessary ions from the acid electrolytic solution. The ion exchanger is filled with ion exchange resin for absorbing ions in its container.

The filtering line 138 may be preferably disposed at more downstream (on the circulation pump side) than the ion removal apparatus because solid matters precipitated and deposited in the ion removal apparatus may flow into the electrolytic solution reservoir 142 or the electrolyzer 110A.

To the electrochemical surface roughening treatment, an electrolytic solution for use in the electrochemical surface roughening treatment using a normal alternating current may be applicable. In particular, a characteristic recess and projection structure can be obtained on the surface by using an electrolytic solution mainly containing hydrochloric acid or nitric acid. In the electrolytic surface roughening treatment, it is preferable to perform a first electrolytic treatment and a second electrolytic treatment using an alternating waveform current in the acid solution before and after a cathode electrolytic treatment. The cathode electrolytic treatment generates hydrogen gas on the surface of the aluminum web 12, and smut is generated, so that the surface condition becomes even; consequently uniform electrolytic surface roughening can be attained in the subsequent electrolytic treatment using the alternating waveform current. This electrolytic surface roughening treatment may be compliant with the electrochemical graining systems (electrolytic graining systems) set forth in the specifications of Japanese Examined Application Publication No. 48-28123 and British Patent No. 896,563. These electrolytic graining systems use an alternating current of a sine waveform, but such a special waveform may be used that is described in Japanese Patent Application Laid-Open No. 52-58602. A waveform described in Japanese Patent Application Laid-Open No. 03-79799 may also be applicable. In addition, systems or methods described in the following patent documents may also be applicable: Japanese Patent Application Laid-Open No. 55-158298, Japanese Patent Application Laid-Open No. 56-28898, Japanese Patent Application Laid-Open No. 52-58602, Japanese Patent Application Laid-Open No. 52-152302, Japanese Patent Application Laid-Open No. 54-85802, Japanese Patent Application Laid-Open No. 60-190392, Japanese Patent Application Laid-Open No. 58-120531, Japanese Patent Application Laid-Open No. 63-176187, Japanese Patent Application Laid-Open No. 01-5889, Japanese Patent Application Laid-Open No. 01-280590, Japanese Patent Application Laid-Open No. 01-118489, Japanese Patent Application Laid-Open No. 01-148592, Japanese Patent Application Laid-Open No. 01-178496, Japanese Patent Application Laid-Open No. 01-188315, Japanese Patent Application Laid-Open No. 01-154797, Japanese Patent Application Laid-Open No. 02-235794, Japanese Patent Application Laid-Open No. 03-260100, Japanese Patent Application Laid-Open No. 03-253600, Japanese Patent Application Laid-Open No. 04-72079, Japanese Patent Application Laid-Open No. 04-72098, Japanese Patent Application Laid-Open No. 03-267400, Japanese Patent Application Laid-Open No. 01-141094. Other than the above systems and methods, an electrolytic treatment may be performed using an alternating current at a special frequency, which is suggested as a manufacturing method of an electrolytic capacitor. For example, such a method is described in the specification of U.S. Pat. No. 4,276,129 and in the specification of U.S. Pat. No. 4,676,879.

Other than nitric acid and hydrochloric acid, electrolytic solutions described in the specifications of the following patent documents may also be applicable to an acid solution that is an electrolytic solution: U.S. Pat. No. 4,671,859, U.S. Pat. No. 4,661,219, U.S. Pat. No. 4,618,405, U.S. Pat. No. 4,600,482, U.S. Pat. No. 4,566,960, U.S. Pat. No. 4,566,958, U.S. Pat. No. 4,566,959, U.S. Pat. No. 4,416,972, U.S. Pat. No. 4,374,710, U.S. Pat. No. 4,336,113, and U.S. Pat. No. 4,184,932.

The concentration of the acid solution is preferably in the range from 0.5 to 2.5 mass %, and more preferable in the range from 0.7 to 2.0 mass % if usage in a desmutting treatment is taken into account. The temperature of the solution is preferable in the range from 20 to 80° C., and more preferably in the range from 30 to 60° C.

The solution mainly containing nitric acid or hydrochloric acid may be prepared by adding, in the range from 1 g/L until a saturated state, at least one of nitric acid compounds having nitrate ions and chlorine compounds having hydrochloric acid ions into a solution of nitric acid or hydrochloric acid having a concentration of 1 to 100 g/L. In this case, the nitrates having the nitrate ions may include aluminum nitrate, sodium nitrate or ammonium nitrate; and the chlorine compounds having the hydrochloric acid ions may include aluminum chloride, sodium chloride or ammonium chloride. Metals contained in an aluminum alloy such as iron, copper, manganese, nickel, titanium, magnesium, and silica may be dissolved in the solution mainly containing nitric acid or hydrochloric acid. It is preferable to use a solution prepared by adding aluminum chloride, aluminum nitrate, or the like into a solution having a hydrochloric acid concentration or a nitric acid concentration in the range from 0.5 to 2 mass % such that an aluminum ions becomes in the range from 3 to 50 g/L.

Adding a compound that forms a complex with Cu allows even an aluminum plate containing plenty of Cu to have an even grained surface. Examples of a compound that forms a complex with Cu may include ammonia; amines obtained by replacing hydrogen atoms of ammonia such as methylamine, ethylamines, dimethylamine, diethylamine, trimethylamine, cyclohexylamine, triethanolamine, triisopropanolamine, EDTA (ethylenediaminetetraacetic acid) with a hydrocarbon group (such as aliphatic and aromatic) or the like; and metal carboxylate such as sodium carbonate, potassium carbonate and potassium bicarbonate. In addition, the following ammonium salts may also be applicable: ammonium nitrate, ammonium chloride, ammonium sulfate, ammonium phosphate and ammonium carbonate. The temperature is preferable in the range from 10 to 60° C., more preferable in the range from 20 to 50° C.

The waveform of an alternating current power source for use in the electrochemical surface roughening treatment is not limited to a specific one, and a sine, rectangular, trapezoidal or triangle waveform may be applicable, but a rectangular or trapezoidal waveform is preferable, and a trapezoidal waveform is more preferable. A current having this trapezoidal waveform preferably reaches the peak from zero at the time period (TP) of 1 to 3 msec. The TP less than 1 msec likely causes variations in treatment called as a chatter mark generated vertically to the traveling direction of the aluminum plate. Particularly in the case of using nitric acid electrolytic solution, the TP above 3 msec, likely causes influence of minor components in the electrolytic solution represented by ammonium ions spontaneously generated in the electrolytic treatment, and this may hinder the even surface graining. Consequently, fouling resistance is likely to be deteriorated when the aluminum web is produced into a planographic printing plate.

A trapezoidal waveform alternating current having a duty ratio in the range from 1:2 to 2:1 may be applicable, and the duty ratio of 1:1 is preferably applicable in an indirect feeding system using no conductor rolls against an aluminum web, as described in Japanese Patent Application Laid-Open No. 05-195300. The frequency of the trapezoidal waveform alternating current may be 0.1 to 120 Hz, but the frequency of 50 to 70 Hz is more preferable for convenience in facilities. The frequency less than 50 Hz encourages dissolution of a carbon electrode as a main electrode, and the frequency exceeding 70 Hz likely causes influences of inductance components of a power source circuit, which increase cost for the power source.

(Nitric Acid Electrolyte)

Pits having an average hole diameter from 0.5 to 5 μm can be formed through the electrochemical surface roughening treatment using an electrolytic solution mainly containing nitric acid. It should be noted that relatively greater electricity causes an intensive electrolytic reaction and also generates honeycomb pits having a hole diameter above 5 μm. In order to obtain such a grained surface, the sum of electricity required for the anode reaction on the aluminum plate until the completion of the electrolytic reaction is preferably in the range from 1 to 1000 C/dm$^2$, and more preferably in the range from 50 to 300 C/dm$^2$. At the same time, the current density is preferably in the range from 20 to 100 A/dm$^2$. Using an electrolytic solution with a high concentration at a high temperature can form a small waveform structure having an average hole diameter of 0.2 μm or less.

(Hydrochloric Acid Electrolyte)

Since hydrochloric acid has a strong aluminum solvent power, slight application of electrolyte can form fine recesses and projections on the surface. These fine recesses and projections have an average hole diameter from 0.01 to 0.2 μm, and they are uniformly formed across the entire surface of the aluminum plate. In order to obtain such a grained surface, the sum of electricity required for the anode reaction on the aluminum web until the completion of the electrolytic response is preferably in the range from 1 to 100 C/dm$^2$, and more preferably in the range from 20 to 70 C/dm$^2$. At the same time, the current density is preferably in the range from 20 to 50 A/dm$^2$.

In such a electrochemical surface roughening treatment using the electrolytic solution mainly containing hydrochloric acid, it is possible to create large crater-like waves by defining the sum of electricity required for the anode reaction to be as great as 400 to 1000 C/dm$^2$, at the same time. In this case, fine recesses and projections having an average hole diameter in the range from 0.01 to 0.4 μm are formed across the entire surface while overlapping the large crater-like waves having an average hole diameter in the range from 10 to 30 μm. In this case, an intermediate wave structure having an average hole diameter from 0.5 to 5 μm cannot be overlapped; thus it is impossible to form a grained surface characterized by the present invention.

It is preferable to perform a cathode electrolytic treatment on the aluminum web 12 between the first and the second electrolytic surface roughening treatments carried out in the electrolytic solution of nitric acid or hydrochloric acid. This cathode electrolytic treatment generates smuts as well as hydrogen gas on the surface of the aluminum web 12, so as to realize more even electrolytic surface roughening. This cathode electrolytic treatment is preferably carried out by using cathode electricity of 3 to 80 C/dm$^2$, more preferably 5 to 30 C/dm$^2$ in the acid solution. If the cathode electricity is less than 3 C/dm$^2$, smuts deposited on the surface may become insufficient; and if the cathode electricity is above 80 C/dm$^2$, smuts deposited on the surface may become too excessive, both of which are unfavorable cases. The electrolytic solution may be different from or identical to the first and the second electrolytic surface roughening treatments <Desmutting Apparatus>

After the electrolytic surface roughening treatment or the alkaline etching treatment, acid cleaning (desmutting) is carried out so as to remove stains (smuts) remaining on the surface. Nitric acid, sulfuric acid, phosphoric acid, chromic acid, hydrofluoric acid, or fluoroboric acid may be used in the acid cleaning. The above described desmutting is carried out by bringing the aluminum plate into contact with an acid solution (containing 0.01 to 5 mass % of aluminum ions) having a concentration of 0.5 to 30 mass % of hydrochloric acid, nitric acid, sulfuric acid, or the like. An example of a method of bringing the aluminum plate into contact with the acid solution may include a method of passing the aluminum web 12 through a tank filled with the acid solution, a method of soaking the aluminum web 12 in the tank filled with the acid solution, or a method of spraying the acid solution on the surfaces of the aluminum web 12.

In the desmutting, a waste solution mainly containing nitric acid or a waste solution mainly containing hydrochloric acid that is discharged during the above described electrolytic surface roughening treatment; or a waste solution mainly containing nitric acid discharged during the anode oxidation treatment described later may be used as the acid solution. The solution temperature in the desmutting treatment is preferably in the range from 25 to 90° C. The treatment time is preferably in the range from 1 to 180 seconds. Aluminum or aluminum alloy components may be dissolved in the acid solution used in the desmutting treatment.

<Anode Oxidation Treatment Apparatus>

The anode oxidation treatment is further applied to the aluminum web 12 treated as described above. A conventional method in the art may be applicable to the anode oxidation treatment.

Figure 5:
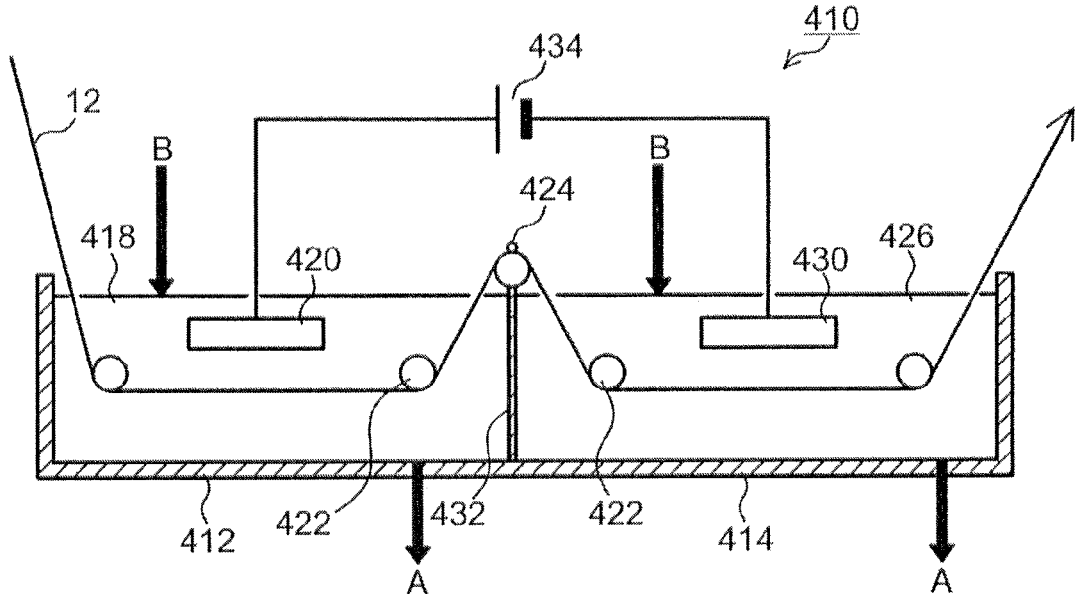
FIG. 5 is a schematic diagram illustrating an example of an anode oxidation film formation apparatus.
Figure 5:
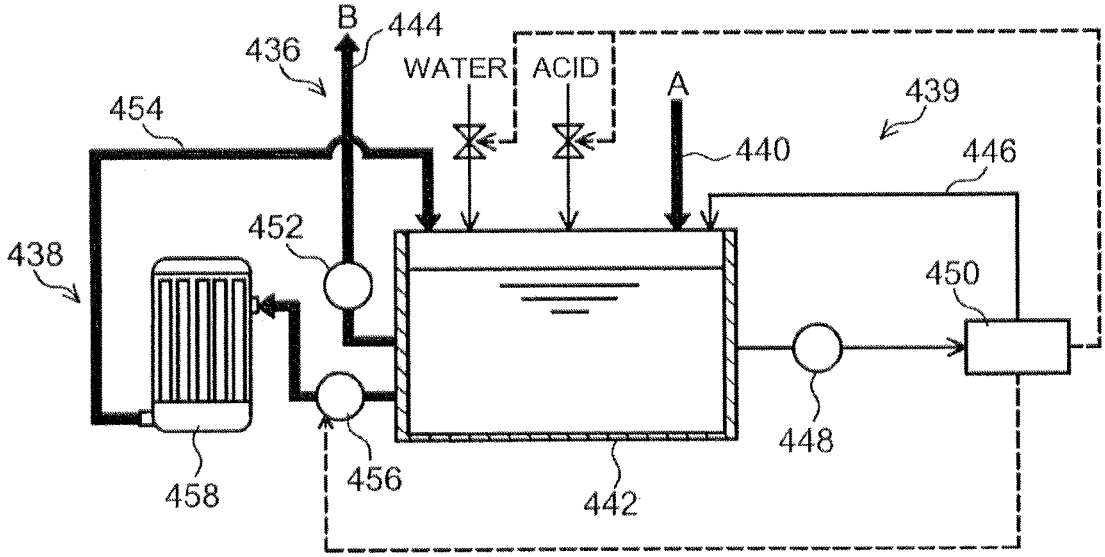

FIG. 5 is a schematic diagram of illustrating an example of the anode oxidation treatment apparatus.

In the anode oxidation treatment apparatus 410, the aluminum web 12 is conveyed in the arrow direction in FIG. 5. The aluminum web 12 is positively charged by a feeding electrode 420 in a feeding tank 412 that stores an electrolytic solution 418. In the feeding tank 412, the aluminum web 12 is conveyed upward through rollers 422, and is directionally converted downward through nip rollers 424, and thereafter, is conveyed toward an electrolytic treatment tank 414 that stores an electrolytic solution 426, and then is directionally converted through rollers 428 in the horizontal direction.

The aluminum web 12 is negatively charged by an electrolytic electrode 430, thereby forming an anode oxidation film on the surface, and the aluminum web 12 coming out of the electrolytic treatment tank 414 is conveyed to a subsequence step. In the anode oxidation treatment apparatus 410, a directional converting means is includes the rollers 422, the nip rollers 424 and the rollers 428, and the aluminum web 12 is so conveyed in the inversed V shape direction and then in the inversed U shape direction through the rollers 422, 424 and 428 at an intermediate part between the feeding tank 412 and the electrolytic treatment tank 414. The feeding electrode 420 and the electrolytic electrode 430 are connected to the DC power source 434.

In the anode oxidation treatment apparatus 410 of FIG. 5, the feeding tank 412 and the electrolytic treatment tank 414 are separated from each other by a tank wall 432, and the aluminum web 12 is conveyed in the inversed V shape direction and in the inversed U shape direction between the tanks. This configuration makes the length of the aluminum web 12 shortest between the tanks. Accordingly, the entire length of the anode oxidation treatment apparatus 410 can be shorter, thereby reducing the facility cost. The configuration of conveying the aluminum web 12 in the inversed V shape direction and in the inversed U shape direction eliminates an aperture for passing the aluminum web 12 through the tank wall between the tanks 412 and 414. Accordingly, it is possible to reduce amount of the solution required for maintaining a required liquid level in the tanks 412 and 414, thereby reducing the operating expense.

The anode oxidation treatment apparatus 410 of FIG. 5 includes a circulation line 436 provided for cyclically using the acid solution, a filtering line 438 for filtering the acid solution cyclically used, and a composition concentration adjustment line 439 for adjusting the composition concentration of the acid solution, as similar to the electrolytic surface roughening apparatus 108.

Discharge pipings 440 for discharging overflown acid solution are provided to the feeding tank 412 and the electrolytic treatment tank 414, respectively. The discharge pipings 440 are extendingly disposed to the upper portion of the acid solution reservoir 442. In FIG. 5, the reference character A designating the discharge piping 440 is connected to the reference character A designating the discharge piping 440 that extends to the acid solution reservoir 442.

A circulation piping 446 is disposed from the center of the side face of the acid solution reservoir 442 to the upper portion of this reservoir. In the middle of the circulation piping 446, there are provided a pump 448 and a measurement device 450 for continuously measuring acid solution characteristics that vary depending on the composition of the acid solution stored in the acid solution reservoir 442.

In addition, the acid solution reservoir 442 is provided with an acid supplemental piping for supplementing high concentration acid (such as hydrochloric acid and nitric acid) and a water supplemental piping for supplementing water, and a valve is also provided to each supplemental piping. The valve of each supplemental piping is controlled to be open and closed based on the measurement result on the measurement device 450. The composition concentration adjustment line 439 is established so as to maintain the composition concentration of the acid electrolytic solution at a constant level.

A supply piping 444 disposed to the bottom portion of the side face of the acid solution reservoir 442 extends to respective acid solution supply ports of the feeding tank 412 and the electrolytic treatment tank 414. In FIG. 5, the reference character B designating the supply piping 444 is connected to the reference characters B designating the respective acid solution supply ports of the feeding tank 412 and the electrolytic treatment tank 414. A pump 452 is disposed to the supply piping 444. This configuration establishes the circulation line 436 for cyclically using the acid solution.

The acid solution reservoir 442 is further provided with a circulation piping 454, and a pump 456 and a filtering apparatus 458 are disposed on the circulation piping 454. This configuration establishes the filtering line 438 for filtering the acid solution. The intake port of the supply piping 444 is disposed to the acid solution reservoir 442, but the circulation piping 454 of the filtering apparatus 458 may be connected to the reference character B designating the acid solution supply port as the supply piping.

A filtering system using filter membranes may be preferably employed in the filtering apparatus 458, as similar to the alkaline etching apparatus 42. In the anode oxidation treatment, the diameter of the solid matters dissolved and precipitated from the aluminum web 12 into the acid solution is approximately in the range from 0.1 μm to 10 μm (1.5 μm in average), which is smaller than that in the alkaline etching treatment.

Accordingly, the pore size of the filter membranes is preferably selected in the range from 1 μm to 10 μm, appropriately. In the anode oxidation treatment, the amount of the solid matters dissolved from the aluminum web 12 into the acid solution is approximately as small as 5 ppm/hr.; thus a simple cartridge type filtering apparatus may be applicable to the filtering apparatus 458.

It is preferable to provide a solid matter concentration measurement means for measuring solid matter concentration of the acid electrolytic solution cyclically used, and a control means for ON-OFF controlling the filtering apparatus 458 based on the measured solid matter concentration such that the solid matter content becomes 20 ppm or less.

FIG. 5 illustrates the case of using the measurement device 450 as the control means, in which the solid matter concentration of the acid solution is calculated based on at least one of the measurement results of the specific gravity and the electric conductivity, which are measured on the measurement device 450. A calibration curve of the specific gravity and the electric conductivity relative to the solid matter concentration is created, and the solid matter concentration is found based on this calibration curve. Alternatively, the solid matter concentration may be found based on the turbidity and the chromaticity of the acid solution, instead of using the specific gravity and the electric conductivity.

For example, the turbidity is preferably maintained at 50 (NTU) or less, and more preferably at 30 (NTU) or less.

If the aluminum web 12 having low purity is used, more solid matters should be removed from the acid solution.

Not shown in the drawing, it may be preferable to arrange the plural filtering apparatuses 458 in series in the filtering line 438 so as to perform the filtering operation in several stages. In this case, it is preferable that the filtering apparatus 458 at an upstream of the line has a greater pore size of the filter membranes and the filtering apparatus 458 at a lower downstream of the line has a smaller pore size thereof. For example, in the two-stage filtering, filtering at the first stage is carried out using the filter membranes having a pore size of 5 to 10 μm, and filtering at the second stage is carried out using the filter membranes having a pore size of 1 to 5 μm. In this case, the pore size of the filter membranes in the second filtering stage is defined to be smaller than that of the filter membranes in the first faltering stage.

The filtered solid matters are preferably dehydrated at the water content of 80% or less, and more preferably at the water content of 60% or less, which results in reduction of waste. The recycle of the dehydrated acid electrolytic solution reduces supplemental amount of new liquid or discharge amount of liquid, which is advantageous in economic efficiency.

In the anode oxidation treatment, it is preferable to remove ions (such as copper ion, manganese ion, magnesium ion, and zinc ion) dissolved in the acid solution as well as to removal of the solid matters.

Figure 6:
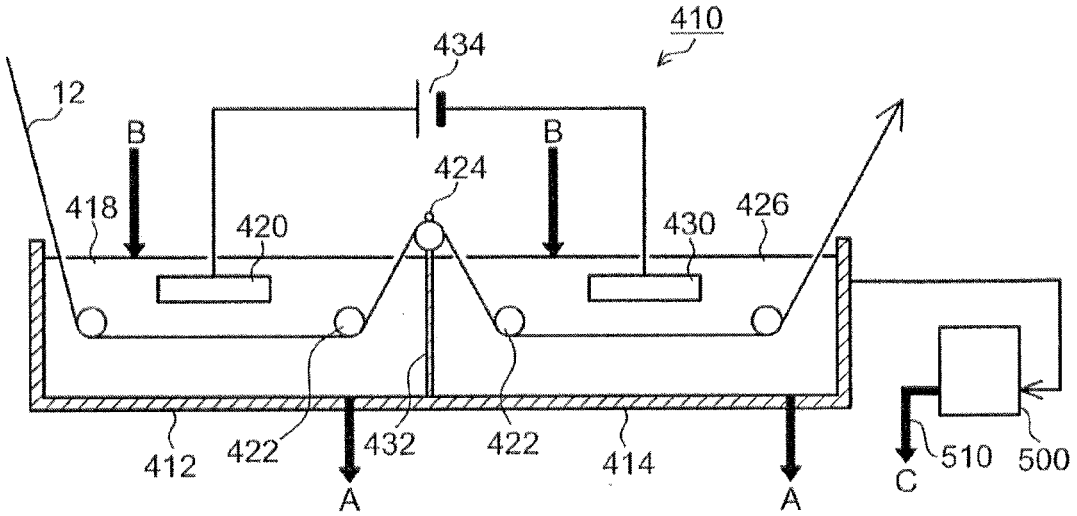
FIG. 6 is a schematic diagram illustrating another example of the anode oxidation film formation apparatus.
Figure 6:
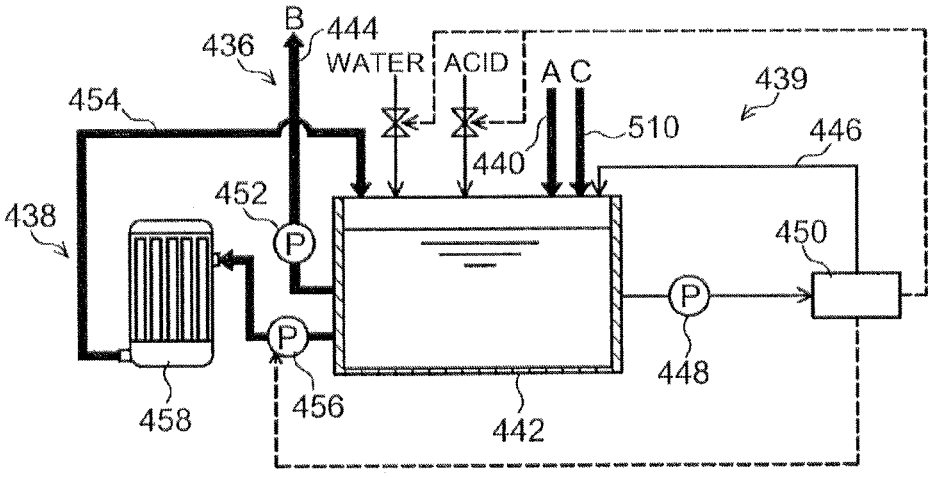

As illustrated in FIG. 6, an ion removal apparatus 500 is disposed at a position at the downstream of the electrolytic treatment tank 414 and at the upstream of the acid solution reservoir 442. The ion removal apparatus 500 is provided with a discharge piping 510, and the acid solution is supplied to the acid solution reservoir 442 through this discharge piping 510. This ion removal apparatus 500 removes copper ions, for example. In FIG. 6, the reference character C designating the discharge piping 510 is connected to the reference character C designating the discharge piping 440 extending to the ion removal apparatus 500.

For example, the reason for removing copper ions is as follow.

In the electrolytic treatment tank 414 of the anode oxidation treatment apparatus 410, aluminum is dissolved as aluminum ions from the aluminum web 12 into the acid solution due to the electrolytic reaction, and copper contained in the aluminum web 12 as impurities is dissolved as copper ions into the acid solution.

When no electrolytic reaction is generated in electrolytic treatment tank 414, the copper ions in the acid solution are precipitated as metallic copper on the surfaces of the aluminum web 12, the electrolytic electrode 430 made of aluminum, or the rollers 422 due to the difference in ionization tendency.

If precipitated metallic copper is deposited to the aluminum web 12, a photosensitive material (photopolymer) applied on the surface of the aluminum web 12 reacts with electrons emitted from the metallic copper, and is dark-polymerized with it when the aluminum web 12 is manufactured into a photopolymer type planographic printing plate (CT plate). The dark-polymerized photopolymer remains as a residual film even after the CT plate is exposed to laser light to be developed, which results in deterioration of quality of images printed on the CT plate as the precursor. For this reason, copper ions should be removed.

The ion removal apparatus 500 may include a reservoir and a metal piece that is placed in the reservoir and has an ionization tendency greater than that of a target ion (such as a copper ion) to be removed, so as to precipitate the target ion onto the metal piece.

It is also possible to precipitate the target ion by using a metal piece having an ionization tendency greater than that of the target ion as the cathode and an insoluble metal piece as the anode.

An ion exchanger may be provided as the ion removal apparatus so as to remove unnecessary ions from the acid electrolytic solution. The ion exchanger is filled with ion exchange resin for absorbing ions in its container.

A filtering line 438 may be preferably disposed at more downstream (on the circulation pump side) than the ion removal apparatus 500 because solid matters precipitated and deposited in the ion removal apparatus 500 may flow into the acid solution reservoir 442.

The anode oxidation treatment apparatus 410 has been described, but this configuration may also be applicable to the aforementioned electrolytic surface roughening apparatus 108.

Sulfuric acid, phosphoric acid, chromic acid, oxalic acid, sulphamic acid, benzene-sulfonic acid, amidosulphonic acid, or the like may be used alone, or more than one of them may be used in combination as a solution for use in the anode oxidation treatment.

At this time, components usually contained at least in the aluminum web 12, the electrodes, tap water, groundwater, and others may be contained in the electrolytic solution. A second component and a third component may further be added therein. The second component and the third component herein may include metallic ions such as Na, K, Mg, Li, Ca, Ti, Al, V, Cr, Mn, Fe, Co, Ni, Cu, Zn; positive ions such as ammonium ions; and negative ions such as nitrate ions, carbonate ions, chloride ions, phosphate ions, fluoride ions, sulfite ions, titanate ions, silicate ions and borate ions, for example. These ions may be contained approximately at a concentration of 0 to 10000 ppm.

The condition of the anode oxidation treatment vary depending on the kind of a solution to be used, so that it cannot be decided to specific one; but the following condition is appropriate in general: the electrolytic solution concentration of 1 to 80 mass %, the solution temperature of 5 to 70° C., the current density of 0.5 to 60 A/dm$^2$, the voltage of 1 to 100 V, the electrolysis time of 15 seconds to 50 minutes. This condition may be adjusted to obtain desired anode oxidation film amount.

Systems or methods described in the following patent documents may also be applicable: Japanese Patent Application Laid-Open No. 54-81133, Japanese Patent Application Laid-Open No. 57-47894, Japanese Patent Application Laid-Open No. 57-51289, Japanese Patent Application Laid-Open No. 57-51290, Japanese Patent Application Laid-Open No. 57-54300, Japanese Patent Application Laid-Open No. 57-136596, Japanese Patent Application Laid-Open No. 58-107498, Japanese Patent Application Laid-Open No. 60-200256, Japanese Patent Application Laid-Open No. 62-136596, Japanese Patent Application Laid-Open No. 63-176494, Japanese Patent Application Laid-Open No. 04-176897, Japanese Patent Application Laid-Open No. 04-280997, Japanese Patent Application Laid-Open No.

06-207299, Japanese Patent Application Laid-Open No. 05-24377, Japanese Patent Application Laid-Open No. 05-32083, Japanese Patent Application Laid-Open No. 05-125597, Japanese Patent Application Laid-Open No. 05-195291.

Particularly, a sulfuric acid solution is preferably used as the electrolytic solution, as described in Japanese Patent Application Laid-Open No. 54-12853 and Japanese Patent Application Laid-Open No. 48-45303. The sulfuric acid concentration of the electrolytic solution is preferably 10 to 300 g/L (1 to 30 mass %), and the aluminum ion concentration of the electrolytic solution is preferably 1 to 25 g/L (0.1 to 2.5 mass %), and more preferably 2 to 10 g/L (0.2 to 1 mass %). Such an electrolytic solution may be adjusted by adding aluminum sulfate or the like into dilute sulfuric acid having a sulfuric acid concentration of 50 to 200 g/L.

If the anode oxidation treatment is carried out in the electrolytic solution containing sulfuric acid, a direct current may be applied between the aluminum web 12 and a counter electrode, or an alternating current may be applied therebetween, instead. If a direct current is applied to the aluminum web 12, the current density is preferably in the range from 1 to 60 A/dm$^2$, and more preferably in the range from 5 to 40 A/dm$^2$. If the anode oxidation treatment is continuously carried out, it is preferable to apply a current having a low current density of 5 to 10 A/m$^2$ at an initial stage of the anode oxidation treatment, and to gradually increase the current density at 30 to 50 A/dm$^2$ or more as the anode oxidation treatment is being progressed, in order to prevent a current from being concentrated on a specific part of the aluminum web 12 so as not to cause so-called "burned spots". A continuous anode oxidation treatment is preferably carried out by a liquid-contact system for feeding electricity to the aluminum web 12 through an electrolytic solution. The anode oxidation treatment under such a condition provides a porous anodic oxide film having a large number of small holes called as "pores (micro pores)". Usually, the average pore size is approximately in the range from 5 to 50 nm, and the average pore density is approximately in the range from 300 to 800 pores/μm$^2$.

The amount of the anode oxidation film is preferably in the range from 1 to 5 g/m$^2$. If this amount is less than 1 g/m$^2$, flaws are likely to be generated on the plate, and if this amount exceeds 5 g/m$^2$, tremendous electric power is required for the manufacturing, resulting in disadvantages in economy. The amount of the anode oxidation film is more preferably in the range from 1.5 to 4 g/m$^2$. The anode oxidation treatment is preferably carried out such that the difference in amount of the anode oxidation film between the middle portion and the vicinity of the edge portion of the aluminum web 12 becomes 1 g/m$^2$ or less.

Electrolytic apparatuses described in Japanese Patent Application Laid-Open No. 48-26638, Japanese Patent Application Laid-Open No. 47-18739 and Japanese Examined Application Publication No. 58-24517 may be applicable to the electrolytic apparatus used in the anode oxidation treatment.

In the present embodiment, no filter aid is used for filtering solid matters in the acid solution, which is generated through the electrolytic surface roughening treatment and the anode oxidation treatment; but a filter aid may be used. The filter aid in this case is not limited to abrasives for use in the alkaline etching treatment, and a common filter aid such as diatomaceous earth or perlite may also be used.

EXAMPLES

Example A

The present invention will now be described in more detail by using Examples of the alkaline etching treatment using the alkaline solution according to the present embodiment. It should be noted that the present invention is not limited to the following Examples.

[Testing Method]

The test was carried out on the circulation line, the filtering line and the composition concentration adjustment line of the alkaline solution 48 in accordance with the following conditions.

(Circulation Line)

In the treatment tank 44 of the alkaline etching apparatus 42, the aluminum web 12 having a width of 1000 mm, a thickness of 0.3 mm, aluminum purity of 99.0 wt % is etched in the alkaline solution 48, and the alkaline solution 48 is cyclically used between the treatment tank 44 and the alkaline solution reservoir 46.

The aluminum web 12 was subjected to a continuous etching treatment in such a condition that allows the aluminum dissolution amount in the alkaline solution cyclically used to be 5 g/m$^2$. The temperature of the alkaline solution 48 used in the alkaline etching treatment was defined to be 65° C. (central temperature between 50 and 80° C.).

(Composition Concentration Adjustment Line)

The alkaline solution 48 cyclically used was measured on the measurement device 68, and water and high concentration alkali were supplemented from the supplemental pipings 70 and 72 based on the measurement result, so as to constantly maintain the alkaline concentration (NaOH concentration) to be 25 mass % as well as the aluminum ion concentration to be 5 mass %.

(Filtering Line)

As shown in the table of FIGS. 7A to 7C, the alkaline solution 48 was filtered through the filtering apparatus 76 in the condition as represented in the table for the Example cases 1 to 14, and the alkaline solution 48 cyclically used was not filtered for the Comparative Examples 1 to 3. The test was conducted on the solid matter content in the alkaline solution before being filtered through the filtering apparatus 76 at each of six content levels: 120, 190, 200, 500, 500, 1500 ppm.

A filter membrane system using filter membranes as a filtering material was employed in the filtering apparatus 76 for the Example cases 1 to 14, and the filtering was carried out at two stages for the Example cases 1 to 9, and the filtering was carried out at one stage for the Example cases 10 to 14. In the Example cases of the two-stage filtering, the pore size of the filtering membranes were different between the first filtering stage and the second filtering stage, as represented in FIGS. 7A to 7C. A measurement device for measuring turbidity is additionally provided as the measurement device for measuring the solid matter content.

[Evaluation Method]

For the Example cases 1 to 14, the solid matter content (concentration) of the alkaline solution before and after the filtering was measured, and evenness of a grained surface of the support for a planographic printing plate manufactured as a finished product was evaluated by means of an electron microscope (SEM) of 200 magnification. Economic efficiency was also evaluated based on the amount of the wasted alkaline solution 48. The total evaluation was conducted for each Example case and each Comparative example based on the above evaluations, and they were classified into three grades: A (Good), B (Fair) and C (Poor). The total evaluations A and B were defined as "acceptable". It should be noted that the grade S for the "Solid Matter Removal Performance" denotes "Excellent".

The item "New Solution Supplemental Amount" in the table of FIGS. 7A to 7C denotes supplemental amount of an unused alkaline solution having a high concentration, and the number "1" represents the new solution supplemental amount as usual. The item "Waste Solution Amount Evaluation" denotes amount of the alkaline solution 48 to be periodically taken out from the alkaline solution reservoir 46, which was as much as the "New Solution Supplemental Amount", and the number "1" represents the amount taken out as usual.

[Test Results]

For the Example cases 1 to 5 of FIGS. 7A to 7C, the solid matter content in the alkaline solution before being filtered through the filtering apparatus 76 was 1500 ppm (turbidity: 600 NTU), and the solid matter content after being filtered was reduced to 100 ppm or less (turbidity: 150 NTU or less), which causes no bad influences on the etching performance. Particularly for the Example case 4, the pore size of 10 μm was used in the first filtering stage and the pore size of 1 μm was used in the second filtering stage, thereby reducing the solid matter content after being filtered at as small as 10 ppm (turbidity: 10 NTU). All the Example cases 1 to 5 had the results of "Even" in the item "Grained Surface Evenness", and had the total evaluations of "A".

For the Example cases 6 to 8, the solid matter content in the alkaline solution before being filtered through the filtering apparatus 76 was 500 ppm (turbidity: 350 NTU), and the solid matter content after being filtered was reduced at 50 ppm or less (turbidity: 80 NTU or less), which causes no bad influences on the etching performance. All the Example cases 6 to 8 had the results of "Even" in the item "Evenness of Grained Surface", and had the total evaluations of "B". The reason for evaluating the Example cases 6 to 8 as "B" was that they were inferior to the Example cases 1 to 5 in filtration durability and economic efficiency.

For the Example case 6, the pore size of 5 μm was used in the first filtering stage and the pore size of 8 μm was used in the second filtering stage, and the pore size in the first filtering stage was set to be smaller than that in the second filtering stage; thus the filtration durability of the membranes in the first filtering stage becomes shorter. For the Example case 7, the pore size of 10 μm was used in the first filtering stage and the pore size of 0.5 μm was used in the second filtering stage, and the pore size in the first filtering stage was set to be greater than that in the second filtering stage, but the pore size in the second filtering stage was too small; thus the filtration durability of the membranes in the second filtering stage becomes shorter.

It should be appreciated from the result of the Example case 6 that it is preferable in the multiple-stage filtering to use a greater pore size in the first filtering stage than that in the second filtering stage. It should be appreciated from the comparison between the Example case 4 and the Example case 7 that it is preferable to use a pore size of 1 μm or more in the second filtering stage.

For the Example case 8, the new solution supplemental amount was increased three times more than the usual supplemental amount, and no cyclical use of the solution was carried out; thus the amount of the waste alkaline solution became three times more than usual, which is inferior in economic efficiency. This result shows that it is economically preferable to perform the filtering without supplementing a new solution and to cyclically use the alkaline solution in the solid matters discharged from the filtering apparatus 76 after deliquoring the alkaline solution.

In the Example case 9, the solid matter content of the alkaline solution before being filtered through the filtering apparatus 76 was 200 ppm (turbidity: 250 NTU), and the pore size of 30 μm was used in the first filtering stage and the pore size of 8 μm was used in the second filtering stage. As a result, the solid matter content after being filtered was reduced at 80 ppm (turbidity: 120 NTU), which causes no bad influences on the etching performance. The Example case 9 had the result of "Even" in the item "Evenness of Grained Surface", and had the total evaluation of "A".

For the Example cases 10 to 14, the solid matter content of the alkaline solution before being filtered through the filtering apparatus 76 was 190 ppm (turbidity: 250 NTU), and the filtering was carried out only at the first filtering stage using the membrane pore sizes of 30 μm, 20 μm, 5 μm, 1 μm, and 0.1 μm. As a result, the solid matter content after being filtered was reduced at 90 ppm or less (turbidity: 140 NTU or less), which causes no bad influences on the etching performance. The Example cases 10 to 14 had the result of "Even" in the item "Evenness of Grained Surface", and the Example cases 10 to 13 had the total evaluations of "A", but the Example case 14 had the total evaluation of "B". This means that the Example case 14 used a too small pore size of 0.1 μm, resulting in shorter filtration duration. Accordingly, it is preferable that the pore size of the filter membranes used in the first filtering stage is also set in the range from 1 to 30 μm, as similar to the Example cases 10 to 13.

Contrary to the Example cases 1 to 14, for the Comparative examples 1 and 2 where the cyclically-used alkaline solution was not filtered, the solid matter content of the alkaline solution was not reduced. Consequently, if the solid matter content of the alkaline solution 48 exceeds 100 ppm through the cyclical use of the alkaline solution 48, as similar to the Comparative examples 1 and 2, the grained surface becomes uneven, which causes bad influences on printing resistance and fouling resistance of a planographic printing plate manufactured as a finished product.

In the Comparative example 3, the new solution supplemental amount was increased five times more than usual without filtering the alkaline solution cyclically used. The new solution supplemental amount was increased five times more than usual, so that the solid matter content of the alkaline solution was reduced from 500 ppm to 100 ppm. Although the grained surface became even, the amount of the wasted alkaline solution 48 became five times more than usual, which increases the running cost and lowers the economic efficiency.

Example B

For the Example B, a study was conducted on influences on the filtration rate in the case of using abrasives as a filter aid and in the case of using no abrasives. At the same time, a study was also conducted on appropriate additive amount of abrasives relative to the alkaline solution 48.

[Test Condition]

(Filtering Condition Using Filter Aid)

- Solid matter content of alkaline solution: 200 ppm
- Filter membranes: filter cloth made of polypropylene with a pore size of 30 μm
- Abrasives: pumice stones having a median diameter of 30 μm and grain diameter distributions of 3 to 100 μm; using various additive amount of the abrasives in the range from 0 to 1.2 g/L, as illustrated in the table of FIG. 8.

<Composition of Pumice Stones>

Silica (silicic acid: $SO_2$): 75 mass %

Alumina ($Al_2O_3$): 15 mass %

Iron oxide ($Fe_2O_3$): 2 mass %

Other components: the rest of 100 mass %

Composition concentration of alkaline solution: as similar to the Example A, the alkaline solution 48 cyclically used was measured on the measurement device 68, and water and high concentration alkali were supplemented from the supplemental pipings 70 and 72 based on the measurement result, so that the alkaline concentration (NaOH concentration) was constantly maintained at 25 mass % and the aluminum ion concentration was constantly maintained at 5 mass %. The temperature of the alkaline solution 48 was set at 65° C. (central temperature between 50 and 80° C.).

[Evaluation Method]

The filtration rate at the filtration pressure of 100 mPa, and the filter membrane cleaning frequency (index) to remove the solid matter accumulation on the filter membrane surfaces were measured, and the total evaluations were conducted for these items. The cleaning frequency for the Test case 7 in which no abrasives were added was defined as the index 1. The total evaluations were classified into three grades: A "Good", B "Fair", and C "Poor". The total evaluations A and B were defined as "acceptable".

[Test Results]

Comparisons were made between the Test case 1 of adding no abrasives into the alkaline solution 48 to be filtered and the Test cases 2 to 8 of adding abrasives thereinto.

As shown in FIG. 8, in the Test case 1 of adding no abrasives, the cleaning frequency was small, but the filtration rate was as small as 0.1 (m/hr.); thus the total evaluation was C on the practical basis.

To the contrary, it was confirmed that the Test cases 2 to 8 of adding abrasives exhibited a more remarkable reduction effect of deterioration of the filtration rate than that of the Test case 1 of adding no abrasives although there were variations in effect among the Test cases 2 to 8.

For the purpose of finding the appropriate additive amount of the abrasives, the additive amount of the abrasives was gradually increased from 0.03 (g/L) for the Test case 2 to 1.2 (g/L) for the Test case 8.

As a result, it should be appreciated that the Test case 2 using the additive amount of 0.03 (g/L) exhibited a reduction effect of deterioration of the filtration rate, compared to the Test case of 1 adding no abrasives, but this reduction effect was small. To the contrary, the filtration rate ranges from 0.8 to 1.0 (m/hr.) at a high level in the Test cases 3, 4, 5 of using the additive amount of 0.05 to 0.3 (g/L), which shows a significant reduction effect of deterioration of the filtration rate.

In the Test cases 6 and 7 having the additive amount of the abrasives as increased as 0.8 (g/L) and 1.0 (g/L), however, the filtration rates were maintained at a relatively high level in the range from 0.6 to 0.7 (m/hr.), but the cleaning frequencies of the filter membranes were 2.5 to 5 times as frequent as those in the Test cases 3 to 5. The further increased additive amount of the abrasives as much as 1.2 (g/L) resulted in not only significant increase in the cleaning frequency of the filter membranes, which was three to five times as frequent as those in the Test cases 3 to 5, but also decrease in the filtration rate as low as 0.3 (m/hr.), thus the total evaluations was "C" on the practical basis.

Accordingly, the appropriate additive amount of the abrasives relative to the alkaline solution was in the range from 0.03 to 1.0 (g/L), and in particular the additive amount of the abrasives in the range from 0.05 to 0.3 (g/L) exhibited preferable results in both the reduction effect of deterioration of the filtration rate and the cleaning frequency.

Example C

The present invention will now be described in more detail by providing an Example of the acid etching treatment using the acid solution according to the present embodiment. It should be noted that the present invention is not limited to the following Example.

The anode oxidation treatment apparatus 410 as illustrated in FIG. 6 was employed, and an aluminum web having a width of 1000 m, a thickness of 0.3 mm, and aluminum purity of 9.0 wt % was subjected to the anode oxidation treatment. The acid solution in the electrolytic treatment tank 414 was adjusted by the measurement device 450 so as to have a sulfuric acid concentration of 15 wt % and an aluminum ion concentration of 1 wt %. The anode oxidation treatment was continuously carried out under the condition that the anode oxidation film amount was 2.0 $g/m^2$, and the electricity was 300 $C/dm^2$.

As shown in the table of FIG. 9, the acid solution was filtered through the filtering apparatus 458 under the condition as represented in the table for the Example cases 1 to 6, and the acid solution was not filtered for the Comparative example 1. The solid matter content of the acid solution before being filtered through the filtering apparatus 458 was defined at 200 ppm and 500 ppm.

A two-stage filtering method using filter membranes was employed in the filtering apparatus 458 for the Example cases 2 and 3. The filtering membranes had different pore sizes between the first filtering stage and the second filtering stage, as represented in FIG. 9. A measurement device for measuring turbidity is prepared as the measurement device for measuring the solid matter content.

The solid matter removal performance was evaluated based on the solid matter concentration and the turbidity of the acid solution after the filtering operation, the mixture of metallic copper in the acid solution circulation piping was evaluated, and the economic efficiency was evaluated based on the solution discharge amount; and then each of these evaluations was classified into four grades: S (Excellent), A (Good), B (Fair), and C (Poor). The total evaluations more than C were defined as "acceptable". In the Example cases 1 to 4 and 6, the solid matter content before being filtered was 200 ppm (turbidity: 250 NTU), and the solid matter content after being filtered was reduced at 20 ppm or less (turbidity: 50 NTU or less).

The Example case 1 was evaluated as the grade "A" regarding the solid matter removal performance and the mixture of metallic copper, and its total evaluation was also "A".

As in the case of the Example cases 2 and 3, the two-stage filtering attained the reduction in the solid matter content of 15 ppm or less (turbidity: 40 NTU or less). Particularly as shown in the Example case 2, the solid matter content and the turbidity were the smallest by using the pore size of 10 μm in the first filtering stage and the pore size of 4 μm in the second filtering stage.

In the Example case 4, the filtering apparatus 458 was disposed at the more upstream than the ion removal apparatus 500, so that the mixture of metallic copper was evaluated as the grade "B".

In the Example case 6, the membranes having a pore size of 4 μm had a shorter filtration duration; thus its total evaluation was "B".

In the Example case 5, the solid matter content before being filtered was 500 ppm (turbidity: 350 NTU), and the solid matter content after being filtered was reduced at 30 ppm or less (turbidity: 70 NTU or less). The solid matter content removal performance was evaluated as the grade "B".

In the Comparative example 1, the acid solution was not filtered; thus the solid matter removal performance was evaluated as the grade "C".

What is claimed is:

1. A manufacturing method of a support for a planographic printing plate including at least an alkaline etching step of dissolving an aluminum surface layer of an aluminum web with an alkaline solution during a surface roughening treatment on a surface of the aluminum web continuously traveling, the manufacturing method comprising:

a circulating step of cyclically using the alkaline solution between a treatment tank for the etching and an alkaline solution reservoir during adjusting composition concentration of the alkaline solution; and a filtering step of filtering the alkaline solution cyclically used so as to remove solid matter in the alkaline solution, wherein in the filtering step, abrasive is added as a filter aid in the alkaline solution to be filtered, and wherein the manufacturing method further comprises a step of performing mechanical surface roughening on the surface of the aluminum web with the abrasive before the alkaline etching step, and used abrasive generated in the mechanical surface roughening step are used in the filtering step.

2. The manufacturing method of a support for a planographic printing plate according to claim 1, wherein in the filtering step, the filtering is carried out by using a filter membrane having a pore size of 1 to 30 μm.

3. The manufacturing method of a support for a planographic printing plate according to claim 2, wherein the filtering step comprises:

a separating step of separating the solid matter from the filter membrane by backwashing the filter membrane;

a deliquoring step of deliquoring the alkaline solution from the separated solid matter; and a returning step of returning the alkaline solution separated in the deliquoring step to the alkaline solution reservoir to recycle the alkaline solution.

4. The manufacturing method of a support for a planographic printing plate according to claim 1, further comprising:

a solid matter concentration measuring step of measuring solid matter concentration of the alkaline solution cyclically used; and a control step of controlling solid matter content of the alkaline solution to be 100 ppm or less based on the measured solid matter concentration.

5. The manufacturing method of a support for a planographic printing plate according to claim 1, wherein in the filtering step, the filtering is carried out at more than one filtering stage if the solid matter concentration is in a range from 200 to 1500 ppm.

6. The manufacturing method of a support for a planographic printing plate according to claim 1, wherein as aluminum purity of an aluminum material used as the aluminum web becomes lower, more solid matter is removed in the filtering step.

7. The manufacturing method of a support for a planographic printing plate according to claim 1, wherein the aluminum web is made of low purity aluminum having an aluminum purity of 99.0% or less.

8. A manufacturing method of a support for a planographic printing plate, comprising a surface roughening step for roughening at least one surface of an aluminum web continuously traveling, the surface roughening step comprising:

an alkaline etching step of etching the aluminum web by bringing the aluminum web into contact with an alkaline solution; and an electrolytic surface roughening step of electrochemically roughening the etched aluminum web in an acid electrolytic solution, the method further comprising an anode oxidation treatment step for performing an anode oxidation treatment on the aluminum web of which surface is roughened in the electrolytic surface roughening step in an acid solution, so as to form an anode oxidation film on the aluminum web, the electrolytic surface roughening step including:

a circulation step for cyclically using the acid electrolytic solution between an electrolyzer and an electrolytic solution reservoir during adjusting composition concentration of the acid electrolytic solution; and a filtering step of filtering the acid electrolytic solution cyclically used so as to remove solid matter in the acid electrolytic solution, and/or the anode oxidation treatment step including:

a circulation step for cyclically using the acid solution between a feeding tank and an acid solution reservoir, and between an electrolytic treatment tank and the acid solution reservoir during adjusting composition concentration of the acid solution; and a filtering step of filtering the acid solution cyclically used, so as to remove solid matter in the acid solution, wherein in the filtering step, abrasive is added as a filter aid in the alkaline solution to be filtered, wherein the manufacturing method further comprises a step of performing mechanical surface roughening on the surface of the aluminum web with the abrasive before the alkaline etching step, and used abrasive generated in the mechanical surface roughening step are used in the filtering step.

9. The manufacturing method of a support for a planographic printing plate according to claim 8, wherein the solid matter is removed through a filter membrane having a pore size of 1 μm to 10 μm in the filtering step of the electrolytic surface roughening step and/or in the filtering step of the anode oxidation treatment step.

10. The manufacturing method of a support for a planographic printing plate according to claim 8, wherein the anode oxidation treatment step further includes a copper ion removal step of reducing copper ion concentration in the acid solution by collecting copper ions from the acid solution in the electrolytic treatment tank.

11. The manufacturing method of a support for a planographic printing plate according to claim 8, wherein the filtering step of the electrolytic surface roughening step further includes:

a measuring step of measuring solid matter concentration of the acid electrolytic solution cyclically used; and a controlling step of ON-OFF controlling the filtering step so as to maintain solid matter content of the acid electrolytic solution at 20 ppm or less based on the measured solid matter concentration.

12. The manufacturing method of a support for a planographic printing plate according to claim 8, wherein the filtering step of the anode oxidation treatment step further includes:

a measuring step of measuring solid matter concentration of the acid solution cyclically used; and a controlling step of ON-OFF controlling the filtering step so as to maintain solid matter content of the acid solution at 20 ppm or less based on the measured solid matter concentration.

13. The manufacturing method of a support for a planographic printing plate according to claim 8, wherein as aluminum purity of an aluminum material used as the aluminum web becomes lower, more solid matter is removed in the filtering step of the electrolytic surface roughening step and in the filtering step of the anode oxidation treatment step.

14. The manufacturing method of a support for a planographic printing plate according to claim 8, wherein the aluminum web is made of aluminum having aluminum purity of 99.0% or less.

* * * * *